US006918822B2

(12) United States Patent
Arai et al.

(10) Patent No.: US 6,918,822 B2
(45) Date of Patent: Jul. 19, 2005

(54) LENS LAYOUT BLOCK DEVICE

(75) Inventors: Michio Arai, Tokyo (JP); Shuichi Sato, Tokyo (JP)

(73) Assignee: Hoya Corporation, Tokyo (JP)

( * ) Notice: Subject to any disclaimer, the term of this patent is extended or adjusted under 35 U.S.C. 154(b) by 0 days.

(21) Appl. No.: 10/203,669

(22) PCT Filed: Feb. 22, 2001

(86) PCT No.: PCT/JP01/01307

§ 371 (c)(1),
(2), (4) Date: Apr. 24, 2003

(87) PCT Pub. No.: WO01/62439

PCT Pub. Date: Aug. 30, 2001

(65) Prior Publication Data

US 2003/0190872 A1 Oct. 9, 2003

(30) Foreign Application Priority Data

Feb. 22, 2000 (JP) ..... 2000-043792
Feb. 22, 2000 (JP) ..... 2000-043794

(51) Int. Cl.[7] ..... B24B 7/30; B24B 41/06
(52) U.S. Cl. ..... 451/42; 451/390
(58) Field of Search ..... 451/42–44, 390, 451/384, 367, 255, 256, 325, 460, 240, 277

(56) References Cited

U.S. PATENT DOCUMENTS 3,962,833 A 6/1976 Johnson
4,118,898 A 10/1978 Godot
4,158,273 A * 6/1979 Olsen et al. ..... 451/42
6,074,290 A * 6/2000 Ko et al. ..... 451/390

FOREIGN PATENT DOCUMENTS

| | | |
|---|---|---|
| JP | 53-120451 | 10/1978 |
| JP | 62-199345 | 9/1987 |
| JP | 62-260113 | 11/1987 |
| JP | 63-278756 | 11/1988 |
| JP | 3-079241 | 4/1991 |
| JP | 6-024852 | 4/1994 |
| JP | 6-143116 | 5/1994 |
| JP | 10-100057 | 4/1998 |
| JP | 11-138405 | 5/1999 |
| JP | 11-216650 | 8/1999 |
| JP | 2000-052214 | 2/2000 |
| JP | 2000-079545 | 3/2000 |

* cited by examiner

*Primary Examiner*—Hadi Shakeri
(74) *Attorney, Agent, or Firm*—Townsend and Townsend and Crew LLP

(57) ABSTRACT

A lens layout block device comprising a seal feeding device that supplies an elastic seal to a seal sticking position (A5). The elastic seal is loaded in a tape loading part in the form of a seal tape covered by a mount and a protective sheet and wound in a roll shape and fed by driving a motor. The protective sheet is separated by a protective sheet separating mechanism. At the seal sticking position (A5), a sensor detects the leading edge of a positioning hole in the mount and stops the conveyance of the seal tape after the seal tape is fed from the detection position for a specified time. The stop position is determined as the reference sticking position of the elastic seal and a lens holder is pressed against the elastic seal from above. The mount is pulled down by the seal separating mechanism to separate the mount from the elastic seal.

8 Claims, 19 Drawing Sheets

LENS LAYOUT BLOCK DEVICE

CROSS REFERENCES TO RELATED APPLICATIONS

This application is a national stage application under 35 U.S.C. 371 of PCT Patent Application No. PCT/JP01/01307 filed on Feb. 22, 2001 and claims priority from Japanese Patent Application No. 043792/2000 filed on Feb. 22, 2000 and Japanese Patent Application No. 043794/2000 filed on Feb. 22, 2000.

BACKGROUND OF THE INVENTION

Spectacle lenses (to be also referred to as lenses hereinafter) include different types such as a single-vision lens, a multifocal lens, and a progressive multifocal lens, and their diameters, outer diameters, lens powers, and the like differ from one lens type to another. Hence, a large number of types of lenses must be fabricated.

Conventionally, edging of such lenses is performed in accordance with the following procedure. For example, assume that a single-vision lens is to be edged. When the prescription lens is determined, if it is an ordinary prescription, a corresponding prescription lens is selected from the stock lenses (mass-production products of the regular inventories). If the prescription lens is a lens not available from the stock lenses (a custom-made article not available from the regular inventories), it is manufactured by the factory in accordance with the order. A stock lens has an upper surface (convex lens surface) and lower surface (concave lens surface) finished with predetermined lens curvatures (curves) on the basis of the optical design to have a predetermined lens power, and is completed until the final step of a surface process such as hardwearing coating or antireflection coating. Regarding a custom-made article, a lens material for it is prepared in advance in the form of a semi-finished product (semi-finished lens blank). The lens material is subjected to roughing-out, polishing, and the like in accordance with the ordered prescription power, and then to a surface process, so it is used as the prescription lens.

Once a prescription lens is manufactured, it is horizontally stored in a lens storing tray, together with a processing instruction slip, with its concave lens surface facing down, and is conveyed to an edging line. The operator takes out this prescription lens from the tray, places it on the inspection table of a predetermined inspecting unit such as a lens meter to check its lens power, cylinder axis, and the like. A processing center, the mounting angle of a processing jig (to be referred to as lens holder hereinafter) with respect to the lens, and the like (optical layout) are determined from the lens information, lens frame shape data, and prescription data about a wearer. On the basis of this information, the lens holder is mounted to the processing center of the lens (positioning). The lens holder is mounted on an edger together with the lens. The lens is edged by a grind stone or cutter, thereby processing the lens into a shape conforming to the shape of an eyeglass frame.

Conventionally, a layout for a lens and lens positioning with a lens holder, which are included in the pre-process for edging of the lens, are performed by an operator using specialized devices. This process is very inefficient and low in productivity, and hence becomes a serious hindrance to labor savings. In particular, an elastic seal is adhered to a lens holder so as to prevent damage to a lens and to hold the lens by this seal, and this adhering operation is cumbersome. In addition, since an operator must handle the lens with great care so as not to soil, damage, and break it, a significant burden is imposed on the operator.

For these reasons, demands have recently arisen for the development of an apparatus for single-vision lenses and multifocal lenses (APS; Auto Positioner for Single Vision Lens, and APM; Auto Positioner for Multi-focus Lens), which is designed to automatically perform a layout for a lens and lens positioning with a lens holder, thereby improving operation efficiency. In the present invention, this apparatus will be referred to as a layout block device.

SUMMARY OF THE INVENTION

It is an object of the present invention to provide an automated lens layout positioning system, which includes an automated lens layout positioner, elastic seal supplying apparatus and a method for adhering an elastic seal to a lens holder in order to solve the conventional problems described above and meet their demands.

More specifically, it is the first object of the present invention to provide a lens layout block device which automatically performs layout and positioning operations for a lens in order to edge the lens, so the operability and productivity are improved and labor savings are enabled.

It is the second object of the present invention to provide an elastic seal supplying apparatus and method for a lens holder which can automatically supply an elastic seal to a lens holder, so operability and operation efficiency are improved.

It is the third object of the present invention to provide, in the layout block device used for edging a lens, an elastic seal adhering method for a lens holder which can automatically adhere an elastic seal to a lens holder, so operability and operation efficiency are improved.

In order to achieve these objects, a lens layout block device of the present invention comprises: a seal supply unit for automatically supplying, to a seal adhering position, an elastic seal which is to be adhered to a lens holder in order to hold a lens, wherein the seal supply unit has a tape loader on which a seal tape formed by covering the elastic seal with a mount and a protector paper and wound in a roll shape is to be loaded, a tape feed mechanism for intermittently feeding the seal tape from the tape loader, a protector paper separating mechanism for separating the protector paper of the seal tape fed from the tape loader, and a seal separating mechanism for separating the elastic seal from the mount when a lens holder is urged against the elastic seal at the seal adhering position.

An elastic seal supplying method of the second present invention is a method of automatically supplying, to a seal adhering position, an elastic seal which is to be adhered to a lens holder in order to hold a lens, comprising the first step of loading a seal tape formed by covering the elastic seal with a mount and a protector paper and wound in a roll shape, the second step of intermittently feeding the loaded seal tape, the third step of separating the protector paper of the fed seal tape, and the fourth step of separating the elastic seal from the mount when a lens holder is urged against the elastic seal at the seal adhering position.

An elastic seal supplying method of the third present invention is an elastic seal supplying method of automatically supplying, to a seal adhering position, an elastic seal which is to be adhered to a lens holder in order to hold a lens, comprising the first step of intermittently feeding a seal tape formed by covering the elastic seal with a mount and a protector paper and wound in a roll shape, the second step of separating the protector paper of the fed seal tape, and the third step of separating the elastic seal from the mount when a lens holder is urged against the elastic seal at the seal adhering position.

An elastic seal supplying unit of the fourth present invention is an elastic seal supplying unit for automatically supplying, to a seal adhering position, an elastic seal which is to be adhered to a lens holder in order to hold a lens, comprising a tape loader on which a seal tape formed by covering the elastic seal with a mount and a protector paper and wound in a roll shape is to be loaded, a tape feed mechanism for intermittently feeding the seal tape from the tape loader, a protector paper separating mechanism for separating the protector paper of the seal tape fed from the tape loader, and a seal separating mechanism for separating the elastic seal from the mount when a lens holder is urged against the elastic seal at the seal adhering position.

An elastic seal adhering method of the fifth present invention is a method of adhering an elastic seal to a lens holder in which the method comprises a seal tape supply unit having a convey mechanism for conveying, to a seal adhering position at a predetermined convey speed in a state wherein a protector paper is separated, a seal tape which is formed by adhering elastic seals to a mount having positioning holes formed at a predetermined pitch so as to coincide the central holes of the elastic seals with the positioning holes, and covers the surfaces of the mount and the elastic seals with the protector paper, and a holder hold unit for holding a lens holder to be vertically movable and to be pivotal within a horizontal plane, and the lens holder is conveyed to the seal adhering position by the holder holding unit and is moved downward, thereby urging the lens holder against the elastic seal to be adhered thereto, wherein when the seal tape is conveyed to the seal adhering position, a sensor detects a front edge of a positioning hole of the mount, conveyance of the seal tape is stopped after the seal tape is fed from the detection position for a predetermined time period, the stop position is determined as a reference adhering position of an elastic seal, and the holder hold unit is driven and controlled on the basis of reference adhering position information to urge the lens holder against the elastic seal to be adhered thereto.

An elastic seal adhering method of the sixth present invention is a method of adhering an elastic seal to a lens holder, which adheres elastic seals to a mount having positioning holes formed at a predetermined pitch so as to coincide the central holes of the elastic seals with the positioning holes, conveys a seal tape formed by covering the surfaces of the mount and the elastic seals with a protector paper to a seal adhering position at a predetermined convey speed in a state wherein the protector paper is separated, holds a lens holder to be vertically movable and to be pivotal within a horizontal plane, conveys the lens holder to the seal adhering position, and moves the lens holder downward, thereby urging the lens holder against the elastic seal to be adhered thereto, wherein when the seal tape is conveyed to the seal adhering position, a sensor detects a front edge of a positioning hole of the mount, conveyance of the seal tape is stopped after the seal tape is fed from the detection position for a predetermined time period, the stop position is determined as a reference adhering position of an elastic seal, and the holder hold unit is driven and controlled on the basis of reference adhering position information to urge the lens holder against the elastic seal to be adhered thereto.

An elastic seal adhering method of the seventh present invention comprises: the step of conveying a seal tape formed by covering surfaces of a mount and an elastic seal with a protector paper to a seal adhering position in a state wherein the protector paper is separated, the step of outputting a detection signal obtained by detecting a front edge of a positioning hole formed in the mount, the step of stopping conveyance of the lens holding portion at a reference adhering position after an elapse of a predetermined time period from output of the detection signal, the step of, when the elastic seal is positioned and stopped at the seal adhering position, making a clamp unit holding a lens holder move above the seal adhering position and be stopped by pivoting a pivotal arm of a holder supply unit on the basis of information of the reference adhering position, and the step of adhering the elastic seal by urging a lens holding surface of the lens holder against an upper surface of the elastic seal by moving the clamp unit downward.

BRIEF DESCRIPTION OF THE DRAWINGS

FIG. 14 is a view showing a relationship among positions of holder mounting, holder transfer, lens holding, seal adhering, and the like;

DETAILED DESCRIPTION OF THE INVENTION

Figure 1A:
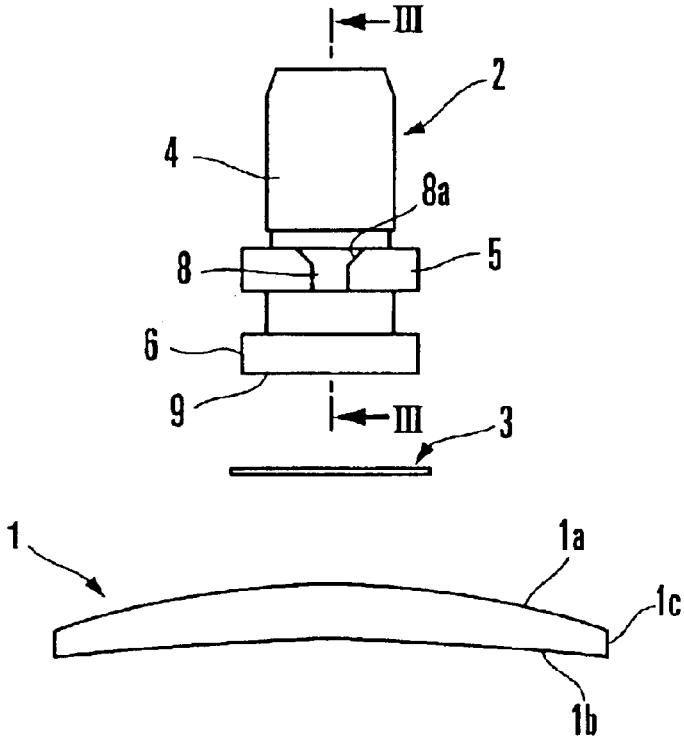
FIGS. 1A and 1B are front and rear views, respectively, of a lens holder.
Figure 1B:
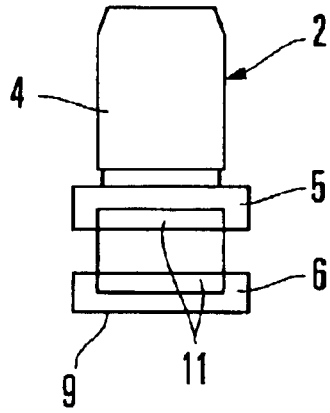

An embodiment of the present invention will be described below with reference to the accompanying drawings.

Structures of a lens and lens holder which are processed by an APS for a single-vision lens will be described on the basis of FIGS. 1A, 1B, 2, 3A, 3B, and 3C.

Referring to FIGS. 1A to 3C, a spectacle single-vision lens 1 (to be merely referred to as a lens hereinafter) made of plastic has a convex lens surface 1*a* and concave lens surface 1*b*. The edge of the lens 1 is edged by an edger to conform to the shape of a lens frame.

The types of lens 1 are almost infinite since one lens power D (diopter) can be combined with convex and concave surface curves, and are actually determined considering the optical aberration and inventory management. More specifically, a lens design in which the number of types of convex surface curves is decreased while different concave surface curves are used is employed. For example, regarding a progressive multifocal lens, up to 8 types of lenses, ranging from a 2-curve lens to 9-curve lens, may be prepared. In the case of a single-vision lens, as it generally copes with a wide range of power, for example, 12 types of lenses, ranging from a 0-curve lens to 11-curve lens, are sometimes prepared. A 0-curve lens is a lens with a flat convex lens surface.

The lens power D is expressed by a difference in curvature between a convex surface curve D1 and a concave surface curve D2. In the semi-finished lenses such as single-vision lenses or progressive multifocal lenses, their lens powers are classified in accordance with only the convex surface curves D1. For example, a single-vision lens with a convex-surface lens power D of 4 is called a 4-curve lens, and its radius of curvature is calculated by $D=(N-1)\times 1000/R$ (mm) where N is the refractive index of the lens, which is 1.50 when the lens material is diethyleneglycol bis allylcarbonate, which is used most generally, and R is the radius of curvature of the convex lens surface. Hence, in the case of a 4-curve lens, when this value is substituted in the above equation, $4=(1.5-1)\times 1000/R$ yields R=125 mm. Similarly, in the case of a 7-curve lens, it is converted into a radius of curvature of about 71 mm. In the case of an 11-curve lens, its radius of curvature is about 45 mm.

A lens holder 2 holds the convex lens surface 1*a* of the lens 1 through an elastic seal 3. As the lens holder 2, to enable stable holding of the lens 1, using specially prepared lens holders for individual lenses with different lens powers D is most desirable, but this considerably increases the types of holders. To prevent this, the several types of lens holding surfaces 9 with gradually different curvatures are prepared and selectively used in accordance with the convex lens curve such that one type of lens holder can actually cover some types of lenses with different convex lens curves. More specifically, for 12 types of single-vision lenses ranging from a 0-curve lens to 11-curve lens, the lenses are classified into three lens groups in accordance with the magnitude of curves, e.g., a first lens group of 0- to 3-curve lenses, a second lens group of 4- to 6-curve lenses, and a third lens group of 7- to 11-curve lenses. The three types of lens holders 2 having lens holding surfaces 9 with different curvatures are prepared in correspondence with the three lens groups, thereby making a lens holder 2 common.

This lens holder 2 is formed of a metal such as stainless steel into a collared cylindrical member, which includes a fitting shaft portion 4, and a flange 5 and lens holding portion 6 integrally formed on the outer surface of the fitting shaft portion 4, closer to the distal end, and at the distal end, respectively. The fitting shaft portion 4 has, for example a length of 35 mm, an outer diameter of about 14 mm, and a central hole 7 with a hole diameter of about 10 mm.

The flange 5 defines the amount of fitting of the fitting shaft portion 4 into a clamp shaft of the edger, and has a thickness of about 5 mm and an outer diameter of about 20 mm. A notched groove 8 is formed in the outer surface of the flange 5 to serve as a rotation preventive portion that prevents rotation of the lens holder 2 with respect to the clamp shaft. A taper surface 8*a* is formed on that opening portion of the notched groove 8 which is opposite to the lens holding portion 6, and is open outward so the fitting shaft portion 4 can be fitted on the clamp shaft easily.

The lens holding portion 6 is formed on the outer surface of the distal end of the fitting shaft portion 4, and has a thickness and outer diameter almost equal to those of the flange 5. A gap of about 5 mm is formed between the lens holding portion 6 and flange 5. That surface of the lens holding portion 6 which comes into tight contact with the elastic seal 3 forms a concave spherical lens holding surface 9 corresponding to the convex lens surface 1*a* of the lens 1. Since the radii of curvatures of the lens holding surfaces 9 differ in the first, second, and third lens groups, as described above, the three types of the lens holder 2 are prepared.

If the radius of curvature of the lens holding surface 9 is larger than that of the convex lens surface 1*a*, only the central portion of the lens holding surface 9 comes into contact with the convex lens surface 1*a*, while the peripheral portion thereof does not come into contact with it. Then, the lens 1 is held unstably. On the contrary, if the radius of curvature of the lens holding surface 9 is smaller than that of the convex lens surface 1*a*, only the peripheral portion of the lens holding surface 9 comes into contact with the convex lens surface 1*a*, while the central portion thereof does not come into contact with it. Thus, the lens 1 is held stably. Therefore, the lens holder 2 is set to have the radius of curvature of the lens holding surface 9 almost equal to or smaller than the minimum one of the radii of curvatures of lenses in a lens group corresponding to this lens holder 2. This makes it possible to stably hold a lens by the peripheral portion of the lens holding surface 9. If, however, a difference in radius of curvature between the convex lens surface 1*a* and lens holding surface 9 is large, the degree of adhesion between these two surfaces is low. Therefore, the smaller this difference, the more desirable.

For this reason, in this embodiment, the three types of lens holders 2 having the lens holding surfaces 9 corresponding to 4-curve, 7-curve, and 11-curve lenses, respectively, are prepared. The 4-curve, 7-curve, and 11-curve lens holders are used for the first lens group of 0- to 3-curve lenses, the second lens group of 4- to 6-curve lenses, and the third lens group of 7- to 11-curve lenses, respectively. Note that only the radii of curvature of the lens holding surfaces 9 are different, and except for that the structures of the three types of lens holders 2, 4-, 7-, and 11-curve holders are completely the same.

A large number of fine projections 10 are radially formed on the entire lens holding surface 9 in order to increase the adhesion bond strength with the elastic seal 3. Each fine projection 10 has an isosceles triangular section. Hence, a wall surface 10*b* in the rotational direction of the lens holder 2 and a wall surface 10*c* opposite to it form slants of the same angle of inclination (e.g., 45°) with respect to a vertex 10*a* of the projection 10 as the boundary. When the slants have the same angle in this manner; the elastic seal 3 comes into tight contact with the two slants evenly. As the contact area increases, the appropriate flexibility and deformability of the seal are utilized, so that the lens holding force can be increased. Since the elastic seal 3 comes into press contact with the two slants of the same angle of inclination evenly, an unbalance rotation force is canceled and is not generated. Therefore, the rotational shift of the elastic seal 3 that decreases the holding precision of the lens does not occur.

A rotation preventive portion 11 is formed on the outer surfaces of the flange 5 and lens holding portion 6 to engage with the engaging portion of a holder storing cassette that stores the lens holder 2. The rotation preventive portion 11 is a groove formed by cutting part of the outer surfaces of the flange 5 and lens holding portion 6 from a direction perpendicular to the axis. The rotation preventive portions 11 and 8 are formed to be phase-shifted from each other by 180° so they are back to back.

A member 13 for discriminating the type of the lens holder 2 is pressed into the lens holder 2 on the proximal end of the fitting shaft portion 4. One end face of the member 13 forms almost one surface together with the proximal end face of the lens holder 2. The member 13 is formed of a synthetic resin into a cylindrical member colored in a required color. The color of the member is as follows. For example, for a 4-curve holder, the member 13 is colored white. For a 7-curve holder, the member 13 is colored red. For a 11-curve holder, the member 13 is colored blue. Therefore, by seeing the color of the member 13, the operator can discriminate at a glance whether the lens holder 2 is a 4-, 7-, or 11-curve holder.

As the elastic seal 3, one which is formed of thin rubber with a thickness of about 0.5 mm to 0.6 mm into a ring shape with an outer diameter (about 22 mm) larger than that of the lens holding surface 9 and an inner diameter (about 8 mm) smaller than the hole diameter of the lens holder 2, and is coated with an adhesive mass on the two surfaces is used.

The structure of an APS for a single-vision lens and the like will be described next with reference to FIGS. 4 to 23.

Figure 4:
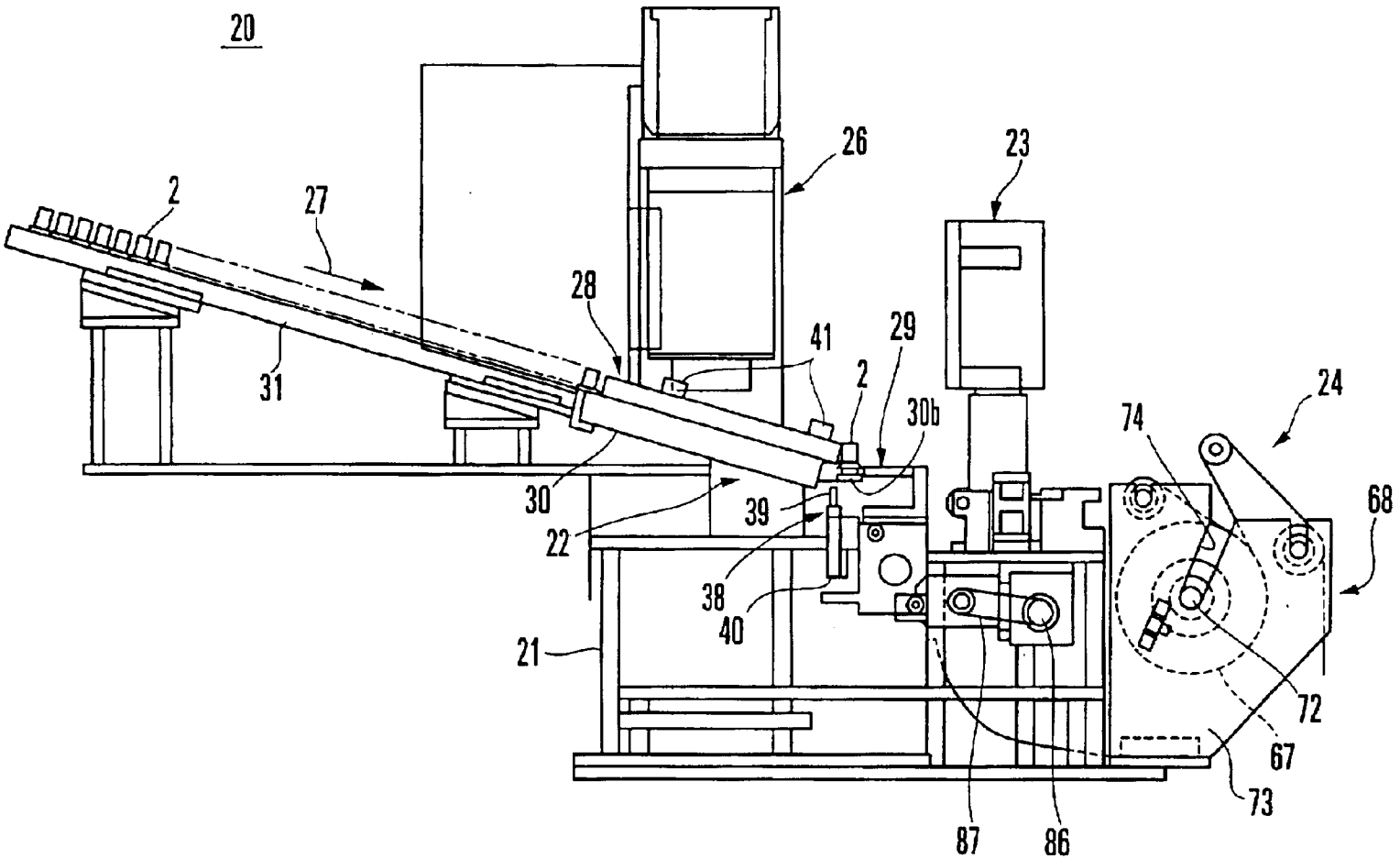
FIG. 4 is a front view of an APS for a single-vision lens.
Figure 5:
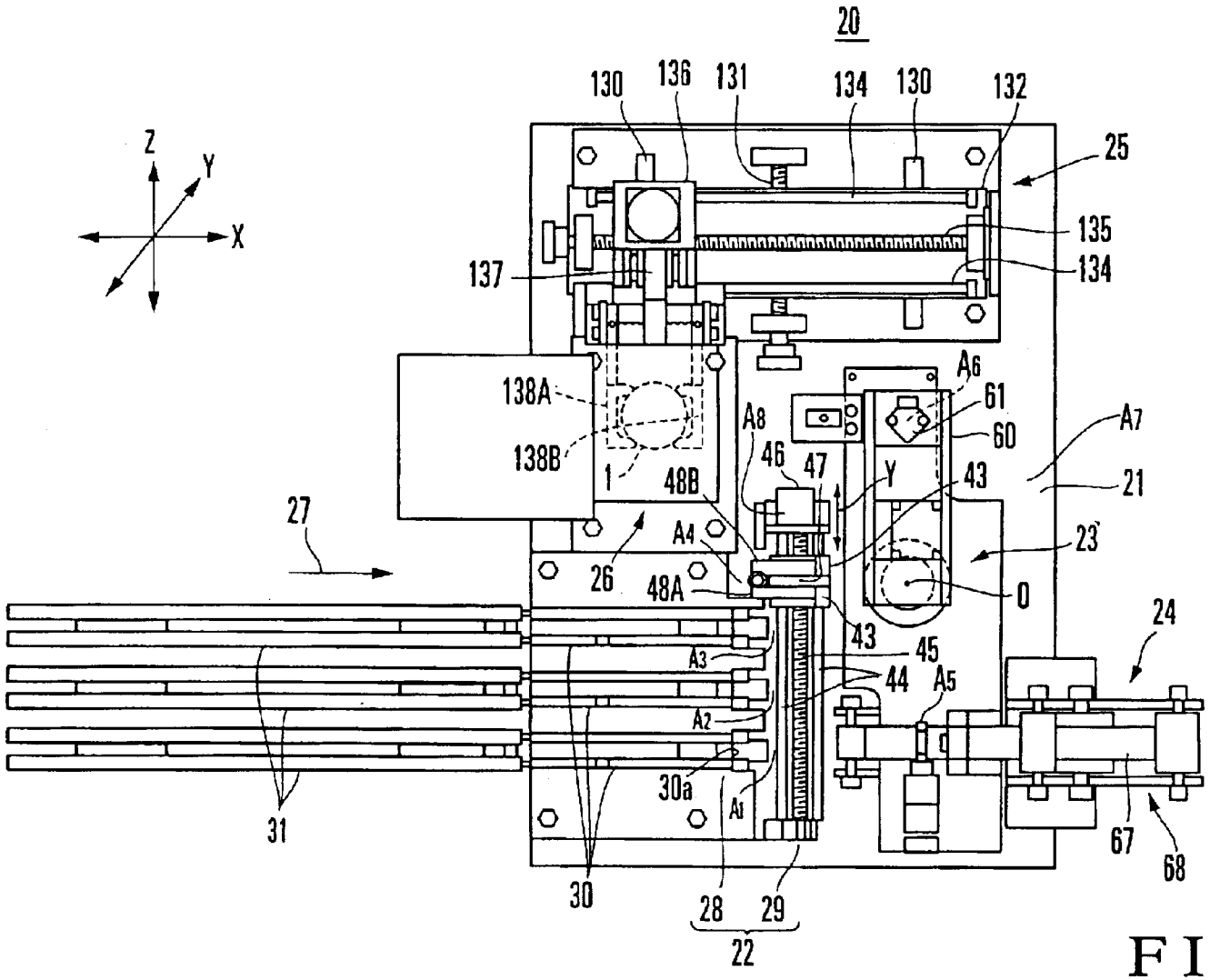
FIG. 5 is a plan view of the APS for the single-vision lens.

Referring to FIGS. 4 and 5, an APS 20 for a single-vision lens is set adjacent to the edger, has a holder conveying unit 22 formed on a base 21, a holder holding unit 23, a seal supply unit 24, a lens supply unit 25, a lens meter 26, and the like, and adopts a batch method of sequentially processing 12 types (0- to 11-curve lenses) of single-vision lenses with different convex surface curves in a random manner.

The holder conveying unit 22 serves to sequentially supply three types of lens holders 2, 4-, 7-, and 11-curve holders to the holder holding unit 23 in accordance with prescription lenses, and has a holder supply mechanism 28 and holder support mechanism 29.

The holder supply mechanism 28 has three chutes 30 which are inclined at such an angle (e.g., 20°) that the lens holders 2 can slide on them by their own weights in the holder supply direction (a direction of an arrow 27 of FIG. 5), and are arranged parallel to each other in the widthwise direction. Three holder storing cassettes 31 each storing a necessary number of (e.g., 42) lens holders 2 for each type are detachably set upstream of the chutes 30 at the same angle as that of the chutes 30.

Referring to FIGS. 4, 5, 6A and 6B, each cassette 31 is formed of a metal, a synthetic resin, or the like into a thin, rectangular hollow body with two open ends. Thus, the cassette 31 stores the lens holders 2 that are aligned in a line while the rotation preventive portions 11 are set in one direction. An opening 33 is formed on the center, in the widthwise direction, of an upper plate 32 of the cassette 31 throughout the entire length. That portion of the lens holder 2 which is closer to the proximal end than the flange 5 projects upward from the cassette 31 through the opening 33. Therefore, the member 13 attached on the proximal end of the lens holder 2 can be visually confirmed from above the cassette 31. When different types of lens holders 2 are mixedly stored in the cassette 31, they can be checked at a glance. Also, erroneous mounting of the cassette 31 can be prevented. In other words, since the cassette 31 itself is identified by the color of the member 13, a mistake that a certain cassette is erroneously set on a chute other than a chute where it should be, and a mistake that a plurality of cassettes which store identical lens holders are set on a plurality of chutes can be prevented.

Figure 6A:
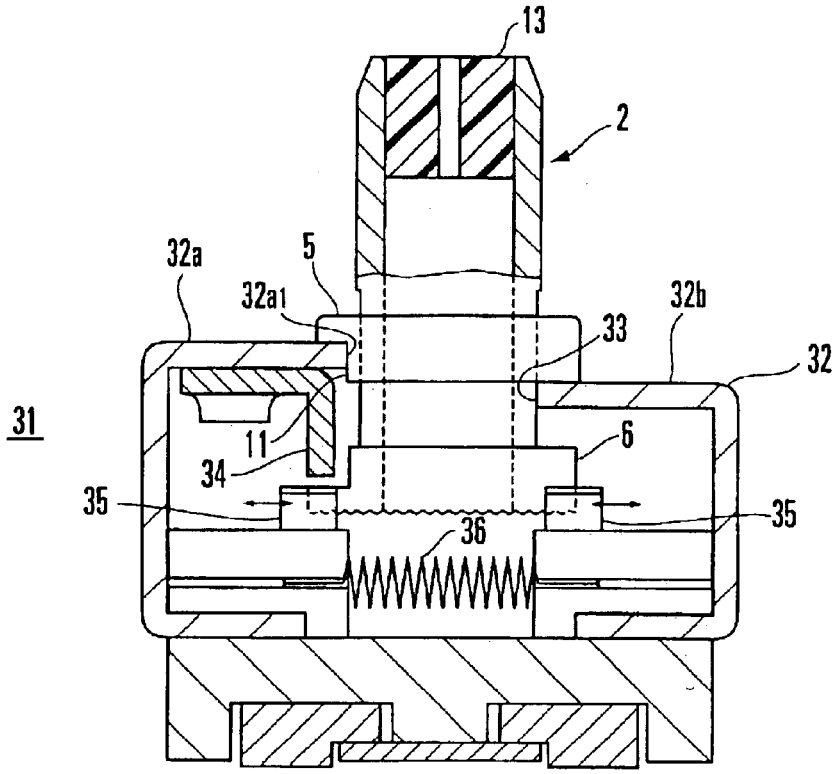
FIGS. 6A, 6B, and 6C are a sectional view of a holder storing cassette, a plan view showing the locked state of the lens holder, and a plan view showing the unlocked state of the lens holder, respectively.
Figure 6B:
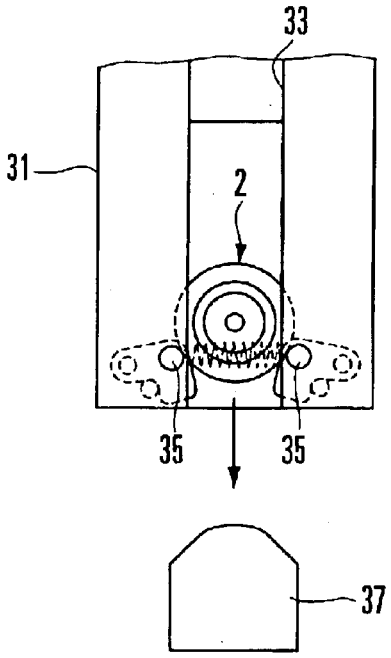
Figure 6C:
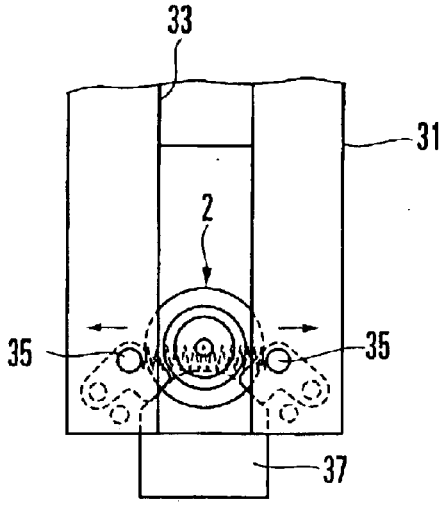

The width of the opening 33 is set to be slightly larger than the outer diameter of the fitting shaft portion 4 of the lens holder 2. The opening 33 slidably supports the lower surface of the flange 5. As shown in FIG. 6A, the upper plate 32 is formed with different heights such that its one plate portion 32*a* is slightly higher than its other plate portion 32*b* through the opening 33 by almost the thickness of the cassette 31. An end edge 32*a*1 of one plate portion 32*a* is inserted in the rotation preventive portion 11 of the lens holder 2. An inverted L-shaped bracket 34 to be inserted in the rotation preventive portion 11 is fixed to the lower surface of the plate portion 32*a*. This sets the direction of the lens holder 2 and prevents free rotation of the lens holder 2. In the cassette 31, a pair of removal preventive pins 35 for preventing removal of the lens holder 2 are disposed near the downstream opening so as to be movable to the left-and-right direction. These pins 35 are connected to each other at their lower ends through a tension coil spring 36 and are biased in directions to come close to each other. Thus, the pins 35 are normally in contact with the lens holding portion 6 to prevent the lens holder 2 from being removed. When the cassette 31 is mounted on the chute 30, the pins 35 move in directions to separate from each other against the tension coil spring 36, thereby unlocking the lens holder 2. The pins 35 are moved in the separating directions by an appropriate member 37 provided to the chute 30.

Figure 7:
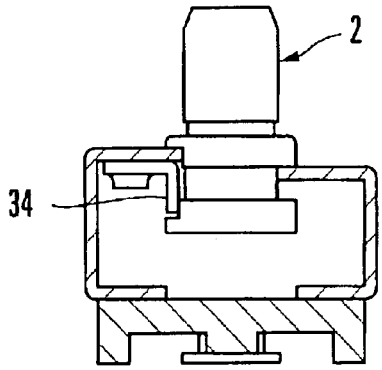
FIG. 7 is a sectional view of the central portion of the cassette away from pin positions.

FIG. 7 is a sectional view of the central portion of the cassette separated from the pin positions. This cassette is different from that in FIG. 6A in that it does not have the pair of removal preventive pins 35.

The lens holders 2 in this cassette 31 slide on the holder storing cassette 31 and chutes 30 by their own weights and sequentially discharge one by one by a shutter mechanism 38. The lens holders 2 are then supported by the holder support mechanism 29.

Figure 8:
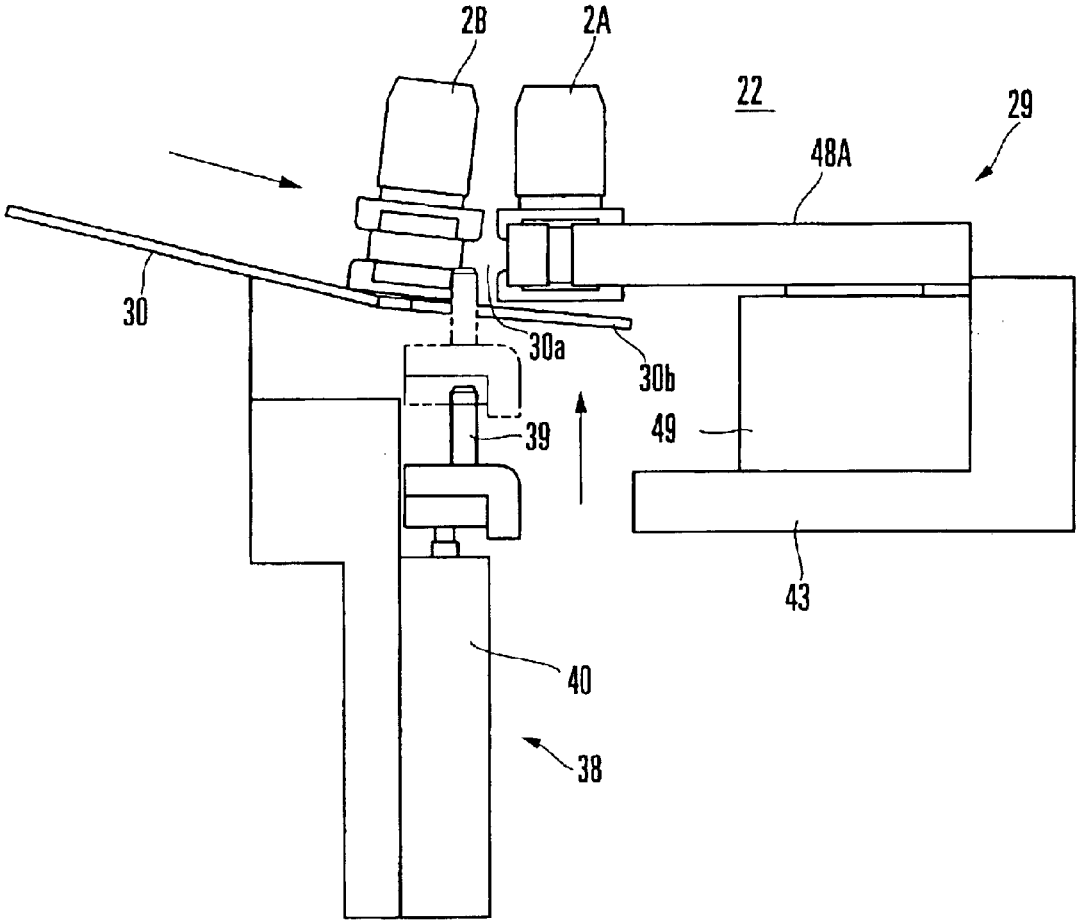
FIG. 8 is a view showing a shutter mechanism of the lens holder.

Referring to FIGS. 4 and 8, the shutter mechanism 38 has a pair of stopper pins 39 for locking a first lens holder 2A by normally closing a discharge port 30*a* of the chute 30, and an air cylinder 40 for vertically moving the stopper pins 39. When the air cylinder 40 is driven by a supply signal from a controller (not shown), the lens holder 2 is discharged from the chute 30. More specifically, when the air cylinder 40 is driven to move the stopper pins 39 downward so as to be retreated from the path of the chute 30, the first lens holder 2A is released from the stopper pins 39, so it is discharged from the discharge port 30*a* of the chute 30 by its own weight and moves onto a terminal end 30*b*. The terminal end 30*b* is set with a small angle of inclination in order to decrease the slide speed of the lens holder 2 and to decrease the impact produced when the lens holder 2 abuts against a stopper 47 (to be described later) of the holder support mechanism 29. When the first lens holder 2A passes, the stopper pins 39 are moved upward to restore to the initial state. Thus, after sliding on the chutes 30 until the positions of the stopper pins 39, a second lens holder 2B is locked by the stopper pins 39, and serves as a new first lens holder. This operation is repeated so the lens holders 2 are automatically supplied one by one. The chute 30 is formed almost identical to the cassette 31, and is fixed on the base 21. Sensors 41 for detecting the absence/presence of the lens holders 2 are attached to two portions, i.e., the downstream and intermediate portions, of the chute 30. The upstream sensor 41 is turned on when the number of lens holders 2 left in the chute 30 is 9, and prompts the operator to replenish. The downstream sensor 41 is turned on when the number of lens holders 2 left in the chute 30 is 1, and stops the layout positioner.

Referring to FIG. 5 and FIGS. 8, 9A and 9B, the holder support mechanism 29 is disposed on the base 21 to oppose the terminal end of the chutes 30, and has a stage 43 which is movable in the back-and-forth direction of the APS 20 (direction of the arrow Y of FIG. 5) to reciprocally move between terminal end positions A1, A2, and A3 of the chutes 30 and a holder mounting position A4. The stage 43 is movably held by a pair of left and right rails 44 and a ball screw 45 which are formed on the base 21. When a driving motor 46 is driven to rotate the ball screw 45, the stage 43 moves along the rails 44 and ball screw 45. The terminal ends 30*b* of the chutes 30 are positioned at the terminal end positions A1, A2, and A3 of the respective chutes 30.

Figure 9A:
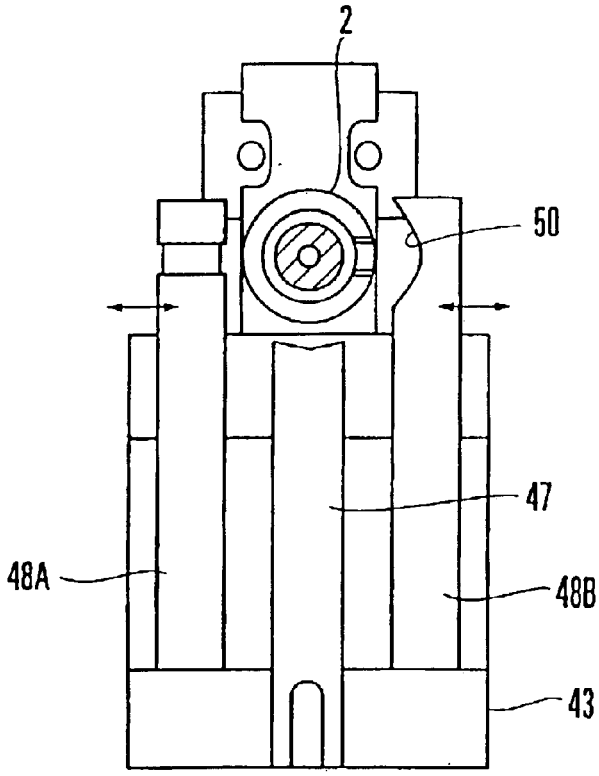
FIGS. 9A and 9B are a plan and front views, respectively, of a holder support mechanism.
Figure 9B:
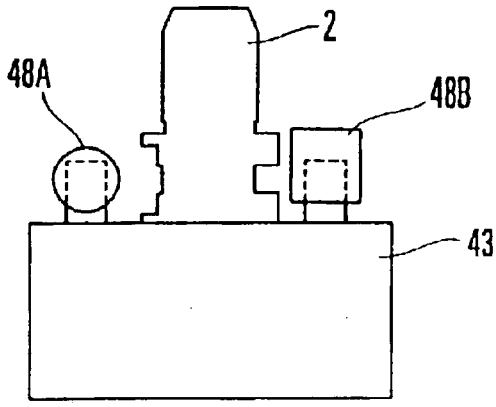
Figure 10A:
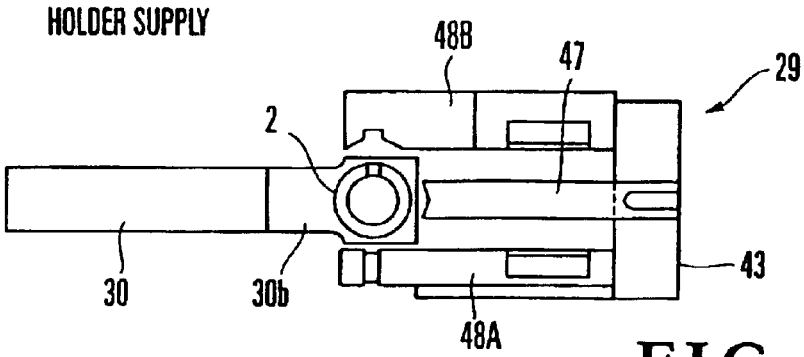
FIGS. 10A and 10B are ton and sided views showing a holder supplying state to the holder support mechanism.
Figure 10B:
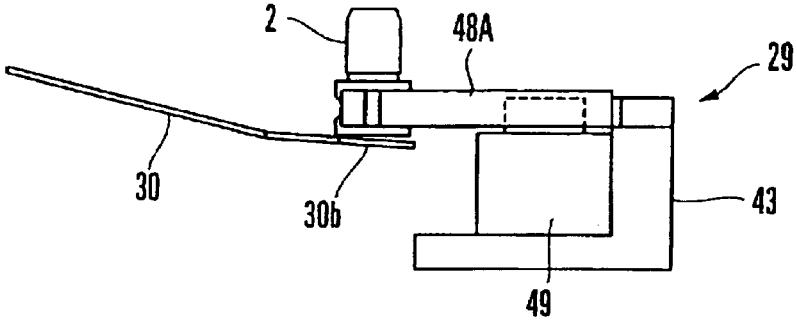
Figure 11A:
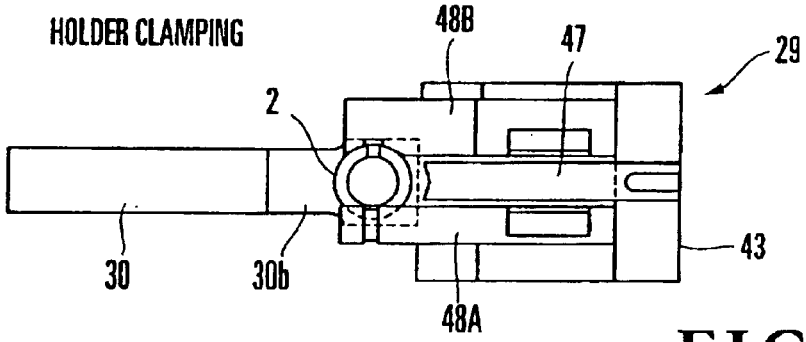
FIGS. 11A and 11B are ton and sided views showing the lens clamping state by the holder support mechanism.
Figure 11B:
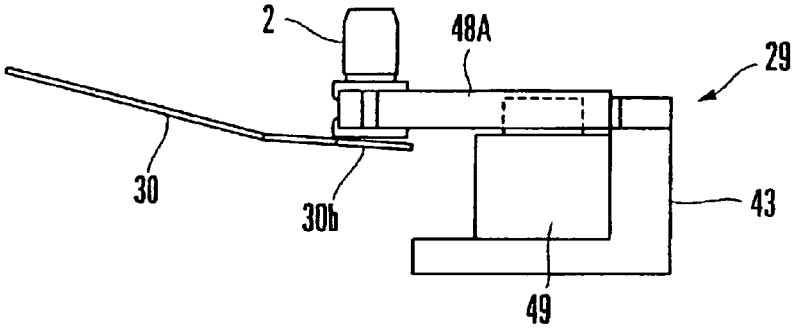

A stopper 47 for receiving the lens holder 2 supplied to the terminal end 30*b* of the chute 30, a pair of holder hands 48A and 48B for supporting the lens holder 2, and an air cylinder 49 for actuating the holder hands 48A and 48B in synchronism to move in directions to be close to and separate from each other are disposed on the upper surface of the stage 43. One holder hand 48A is formed of a rod-like member with a circular section, and holds the rotation preventive portion 11 of the lens holder 2 with the outer surface of its distal end. The other holder hand 48B is formed of a rod-like member with a rectangular section, and has a V-shaped recess 50 in that side surface of its distal end which opposes the lens holder 2. The recess 50 holds the outer surfaces of the flange 5 and lens holding portion 6 on that side of the lens holder 2 which is opposite to the rotation preventive portion 11. When the lens holder 2 is to be supplied, this stage 43 has moved in advance to the terminal position of that chute of the three chutes 30 to which the lens holder 2 is to be supplied, i.e., the position A1, and waits there with the holder hands 48A and 48B being open (FIGS. 9A and 9B). When the lens holder 2 is supplied onto the terminal end 30*b* of the chute 30, the stopper 47 receives it (FIGS. 10A and 10B), and the pair of holder hands 48A and 48B are closed to clamp it (FIGS. 11A and 11B). After that, the clamped lens holder 2 is conveyed to the holder mounting position A4 to perform centering of the lens holder 2, and the processed lens holder 2 is then transferred to the holder holding unit 23.

Figure 12C:
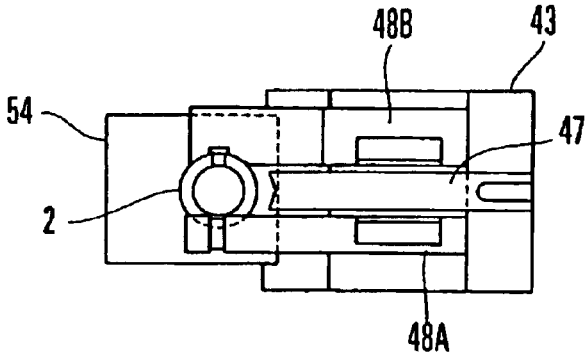
FIGS. 12A and 12B and 12C are views showing centering operation for the lens holder performed by a centering mechanism.
Figure 12A:
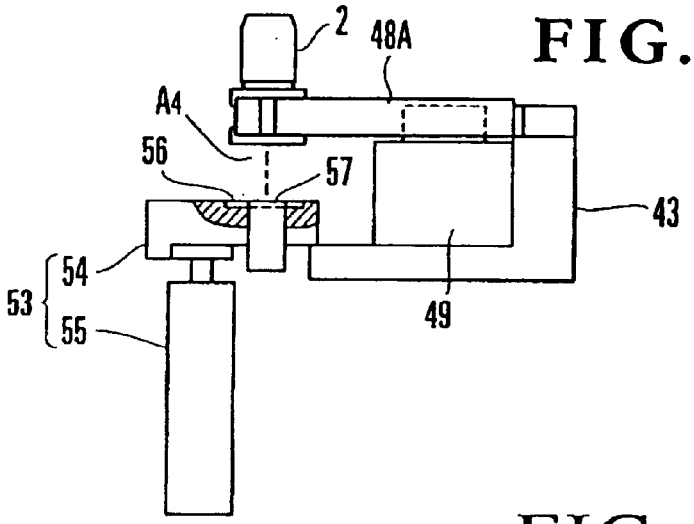
Figure 12B:
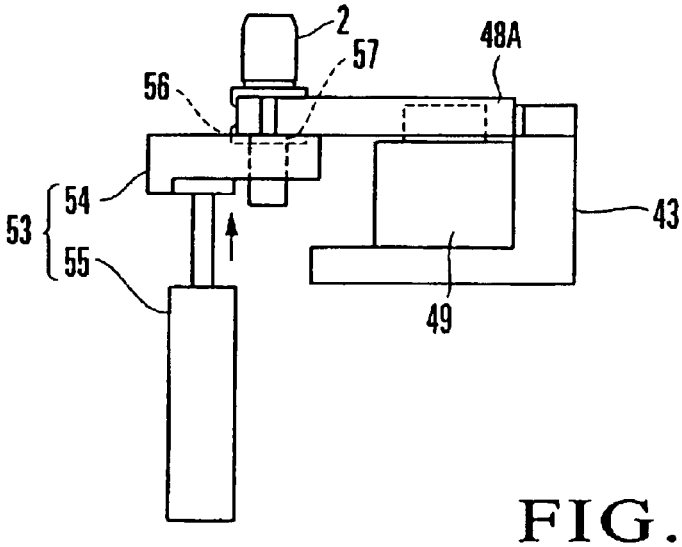
Figure 13:
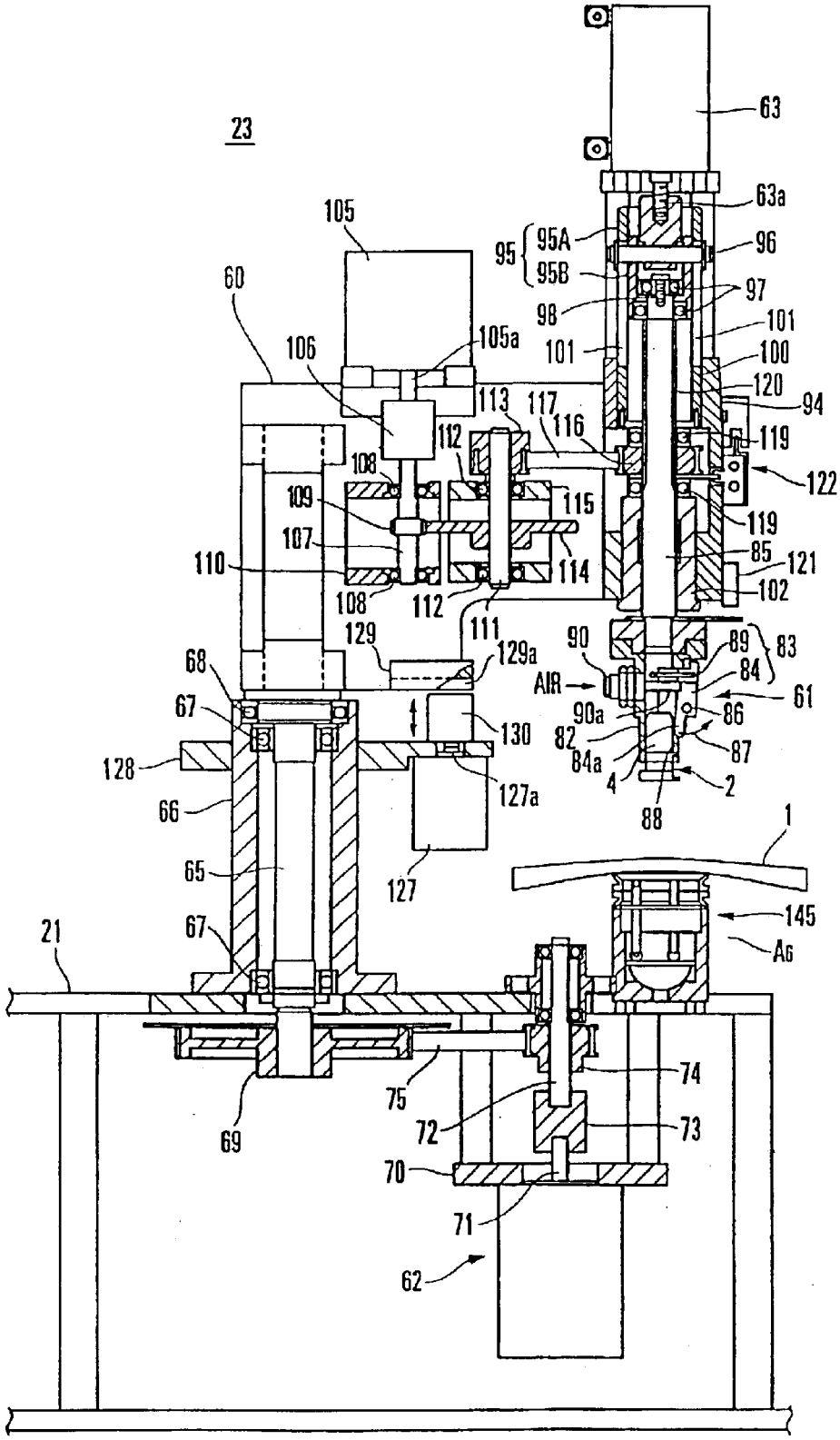
FIG. 13 is a sectional view of a holder holding unit.

Referring to FIGS. 12A, 12B and 12C, a centering mechanism 53 is disposed at the holder mounting position A4 to perform centering of the lens holder 2 supported by the holder hands 48A and 48B. The centering mechanism 53 is constituted by an elevating table 54 and an air cylinder 55 for vertically moving the elevating table 54. The upper surface of the elevating table 54 has a comparatively shallow recess 56 with a hole diameter slightly larger than the outer diameter of the lens holding portion 6 of the lens holder 2. A circular projection 57 is formed at the center of the recess 56, and has a diameter slightly smaller than a central hole 7 (FIG. 3) of the lens holder 2. The elevating table 54 is usually located almost immediately below the lens holder 2 to be separate from it (FIG. 12A and FIG. 12C). In centering the lens holder 2, when the air cylinder 55 is driven to move the elevating table 54 upward (FIG. 12B), the recess 56 receives the lens holding portion 6 of the lens holder 2, and the projection 57 fits in the central hole 7 so the center of the lens holder 2 and that of the projection 57 coincide with each other, thereby centering the lens holder 2. At this time, the air cylinder 49 is deenergized to make the pair of the holder hands 48A and 48B flexible, thus enabling centering, so the lens holder 2 is held to be movable in the left-and-right and back-and-forth directions. After the lens holder 2 is centered, the air cylinder 49 is reenergized to clamp the lens holder 2, and the elevating table 54 moves downward successively to restore to the original initial position, thus ending centering.

Referring to FIG. 5 and FIGS. 13 to 15A and 15B, the holder holding unit 23 is disposed, on a side of the holder support mechanism 29, in a space between the seal supply unit 24 and lens supply unit 25. At the holder mounting position A4, when the holder holding unit 23 receives the lens holder 2 centered from the holder support mechanism 29, it conveys the lens holder 2 to a seal adhering position A5 to adhere the elastic seal 3 to the lens holding surface 9 of the lens holder 2 it holds. After that, the holder holding unit 23 conveys the lens holder 2 to a lens holding position A6, so the lens 1 is held by the elastic seal 3. The holder holding unit 23 has a pivotal arm 60, a clamp unit 61 attached to the distal end of the pivotal arm 60 to hold the lens holder 2, an arm driving motor (arm driving unit) 62 for pivoting the pivotal arm 60 within a horizontal plane, a clamp driving unit 63 for vertically moving the clamp unit 61, and the like.

The pivotal arm 60 is fixed to the upper end of a vertical rotating shaft 165 standing upright on the base 21. The rotating shaft 165 is disposed in a cylinder 166, standing upright on the base 21, to be rotatable through radial bearings 167 and thrust bearing 168. A toothed pulley 169 is fixed to the lower end of the rotating shaft 165. The driving motor 62 is vertically fixed to an attaching member 170 formed on the base 21, with its output shaft 71 facing up. The output shaft 71 is connected to a shaft 72 through a coupling 73. The shaft 72 has a toothed pulley 74. A timing belt 75 extends between the pulleys 74 and 69. When the driving motor 62 is driven to rotate the output shaft 71, this rotation is transmitted to the rotating shaft 165 through the coupling 73, shaft 72, pulley 74, timing belt 75, and pulley 69, so it can pivot the pivotal arm 60 within a horizontal plane. The pivot angle of the pivotal arm 60 is 300° in this embodiment.

The clamp unit 61 is constituted by a cylindrical main body 82 to fit on the fitting shaft portion 4 of the lens holder 2, a holder fixing mechanism 83 for fixing the lens holder 2 to the main body 82 to prevent it from removing, and the like. The main body 82 is fixed to the lower end of a holding shaft 85 disposed to the distal end of the pivotal arm 60 to be vertically movable and rotatable. The holder fixing mechanism 83 has a holder fixing member 84 axially supported by a support pin 86, formed on the main body 82, to be pivotal in the direction of an arrow 87 in FIG. 13, and the like. The holder urging member 84 fixes the lens holder 2 to the main body 82 by urging, has an urging portion 84*a* at its lower end to urge the fitting shaft portion 4 of the lens holder 2, is disposed in an elongated hole 88 formed in the outer surface of the main body 82 and long in the axial direction, and is biased by a tension coil spring 89 counterclockwise in FIG. 13. Thus, usually, the urging portion 84*a* projects to the outside of the main body 82. This allows the lens holder 2 to be fitted in the main body 82 easily.

Furthermore, the holder fixing mechanism 83 has an air cylinder 90 for operating the holder fixing member 84. The air cylinder 90 is attached to the outer surface of the main body 82 with its operational rod 90*a* opposing the holder fixing member 84. When the fitting shaft portion 4 of the lens holder 2 is fitted in the main body 82, air is supplied to the air cylinder 90 to actuate it. Thus, the movable rod 90*a* urges the holder fixing member 84 to pivot it clockwise against the tension coil spring 89. Therefore, the urging portion 84*a* of the holder fixing member 84 urges the fitting shaft portion 4 of the lens holder 2 against the inner surface of the main body 82, thereby preventing the lens holder 2 from being removed.

The shaft 85 extends through an outer cylinder 94 fixed to the distal end of the pivotal arm 60 to be vertically movable and rotatable. The upper end of the shaft 85 is connected to the clamp air cylinder 63 through a coupling 95, and the lower end thereof extends through a sleeve 102, disposed in the lower portion of the interior of the outer cylinder 94, to be rotatable and vertically movable. The coupling 95 is constituted by a columnar first coupling 95A fixed to the movable rod 63*a* of the air cylinder 63, and a cylindrical second coupling 95B connected to the first coupling 95A through a connection pin 96. The coupling 95 rotatably axially supports the upper end of the shaft 85 with bearings 97 disposed in the second coupling 95B, and prevents the shaft 85 from dropping from the second coupling 95B with a set screw 98. The two ends of the connection pin 96 are slidably supported by an inner cylinder 100 arranged in the outer cylinder 94 to project upward. This prevents rotation of the second coupling 95B. A pair of guide holes 101 for guiding the connection pin 96 are formed in the wall portions of the inner cylinder 100 to be long in the axial direction. When the air cylinder 63 is driven to move the movable rod 63*a* downward, the clamp unit 61 is moved downward together with the shaft 85.

A driving motor 105 for pivoting the clamp unit 61 is set on the upper surface of the pivotal arm 60 to face down. The driving motor 105 serves to pivot the clamp unit 61 in accordance with the angle of cylinder axis. An output shaft 105*a* of the driving motor 105 is connected to the upper end of a driven shaft 107 through a coupling 106. The driven shaft 107 is rotatably axially supported by bearings 108 provided to an attaching member 110, and a small-diameter gear 109 is fixed to its intermediate portion. The attaching member 110 is fixed to the pivotal arm 60. A transmission shaft 111 is disposed on a side of the driven shaft 107 to be parallel to it. The transmission shaft 111 is rotatably axially supported by bearings 112 provided to an attaching member 115. A toothed pulley 113 is fixed to the upper end of the transmission shaft 111, and a large-diameter gear 114 to mesh with the small-diameter gear 109 is fixed to the intermediate portion of the transmission shaft 111. The attaching member 115 is fixed to the pivotal arm 60.

A toothed pulley 116 is disposed at the intermediate portion of the shaft 85 to correspond to the toothed pulley 113. A timing belt 117 extends between the pulleys 113 and 116. The toothed pulley 116 is disposed between the inner cylinder 100 and sleeve 102 to be rotatable through bearings 119, and is attached to the shaft 85 through spline fitting to be slidable relative to it. Hence, a groove 120 long in the axial direction is formed in the outer surface of the shaft 85. A projection to slidably fit in the groove 120 projects from the inner surface of the toothed pulley 116. Therefore, rotation of the driving motor 105 is decelerated by the gears 109 and 114, and is transmitted to the shaft 85 through the toothed pulleys 113 and 116 and timing belt 117, to pivot the clamp unit 61 through the angle of cylinder axis.

An origin sensor 121 for positioning the shaft 85 at the position of origin and a limit sensor 122 for limiting the pivot range of the shaft 85 to 360° are disposed on the outer cylinder 94.

An arm fixing unit 127 is attached to the cylinder 166 through an attaching plate 128. A rotation preventive member 129 is fixed to the lower surface of the pivotal arm 60 to correspond to the arm fixing unit 127. Upon pivot motion of the pivotal arm 60, when the clamp unit 61 is moved to the lens holding position A6 and is stopped there, the arm fixing unit 127 temporarily fixes the pivotal arm 60 at this pivot position, to prevent rotation of the clamp unit 61 when the clamp unit 61 is urged against the lens 1. An air cylinder is used as this arm fixing unit 127, and is fixed to the attaching plate 128 with its movable rod 127*a* facing up. An inverted V-shaped engaging member 130 is attached to the upper end of the movable rod 127*a*. A V-shaped groove 129*a* is formed in the lower surface of the rotation preventive member 129, and engages with the engaging member 130 when the clamp unit 61 moves to the lens holding position A6 and stops there.

Figure 14:
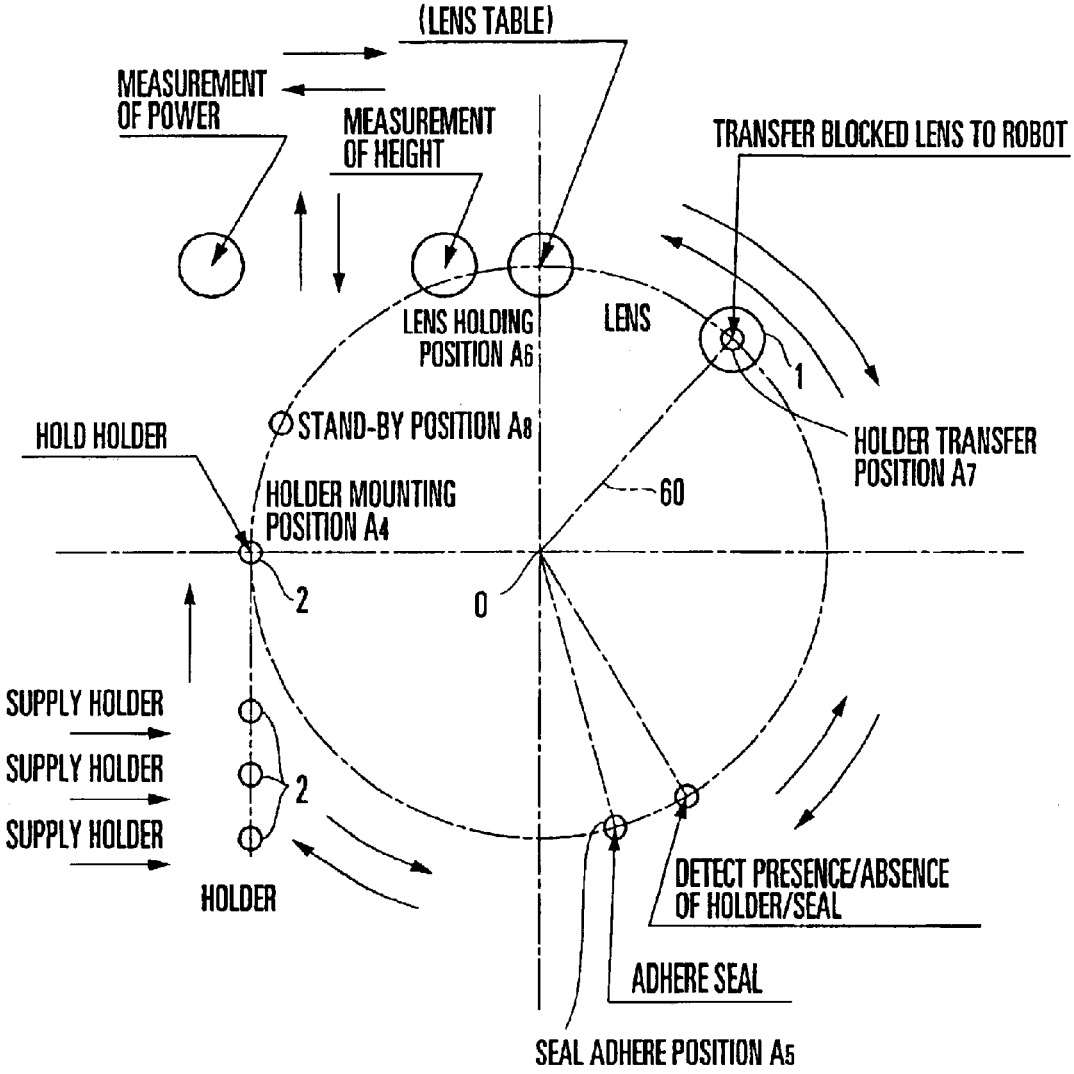

As shown in FIG. 14, the holder mounting position A4, the seal adhering position A5, the lens holding position A6, and a holder transfer position A7 are formed to be located on one circumference with a rotation center O of the pivotal arm 60 as the center and a radius corresponding to the distance to the clamp unit 61. The holder mounting position A4 is where the clamp unit 61 receives the lens holder 2 from the holder support mechanism 29 and holds it. The seal adhering position AS, holder transfer position A7, and lens holding position A6 are shifted from the holder mounting position A4 counterclockwise by 120°, 230°, and 270°, respectively. The seal adhering position A5 is where the elastic seal 3 is adhered to the lens holder 2 held by the clamp unit 61. The lens holding position A6 is where the lens 1 is held by the lens holder 2, held by the clamp unit 61, through the elastic seal 3. The holder transfer position A7 is where the lens holder 2 (held by the clamp unit 61) that holds the lens 1 is transferred to a convey robot so it is supplied to the edger. A stand-by position A8 where the clamp unit 61 is set in the stand-by state is formed between the holder mounting position A4 and lens holding position A6.

Figure 15A:
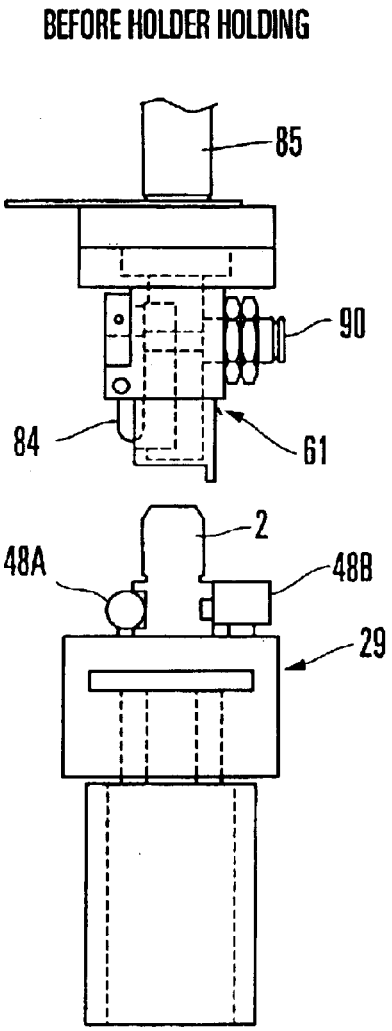
FIGS. 15A and 15B are views showing transfer of lens holder to a holder holding apparatus, which show a state before holding a holder and a holder holding state, respectively.
Figure 15B:
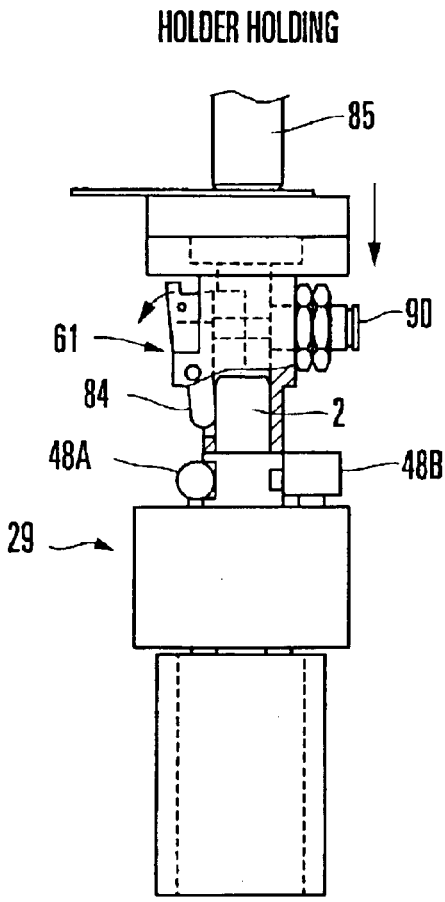

When the clamp unit 61 is to hold the lens holder 2, the pivotal arm 60 is pivoted to move the clamp unit 61 to above the holder mounting position A4, as shown in FIGS. 15A and 15B (FIG. 15A). When the clamp unit 61 is stopped above the holder mounting position A4, the air cylinder 63 (FIG. 13) is driven to move the shaft 85 downward, and the main body 82 of the clamp unit 61 is fit on the fitting shaft portion 4 of the lens holder 2 from above (FIG. 15B).

Subsequently, the air cylinder 90 is driven to pivot the holder fixing member 84 clockwise against the tension coil spring 89, so the urging portion 84*a* of the holder fixing member 84 is urged against the fitting shaft portion 4. When the holder arms 48A and 48B of the holder support mechanism 29 are opened to release the lens holder 2, the lens holder 2 is held by the clamp unit 61. Thus, transfer of the lens holder 2 from the holder support mechanism 29 to the clamp unit 61 is ended. The clamp unit 61 moves upward again, to convey the lens holder 2 it holds to the seal adhering position A5 with the pivot motion of the pivotal arm 60.

Referring to FIGS. 4 and 5 and FIGS. 16 to 22, the seal supply unit 24 serves to intermittently supply the elastic seal 3 to the seal adhering position A5 in accordance with supplying of the lens holder 2 by the holder conveying unit 22, and is disposed at the seal adhering position A5 to oppose the holder supply mechanism 28 through the holder support mechanism 29.

Figure 22:
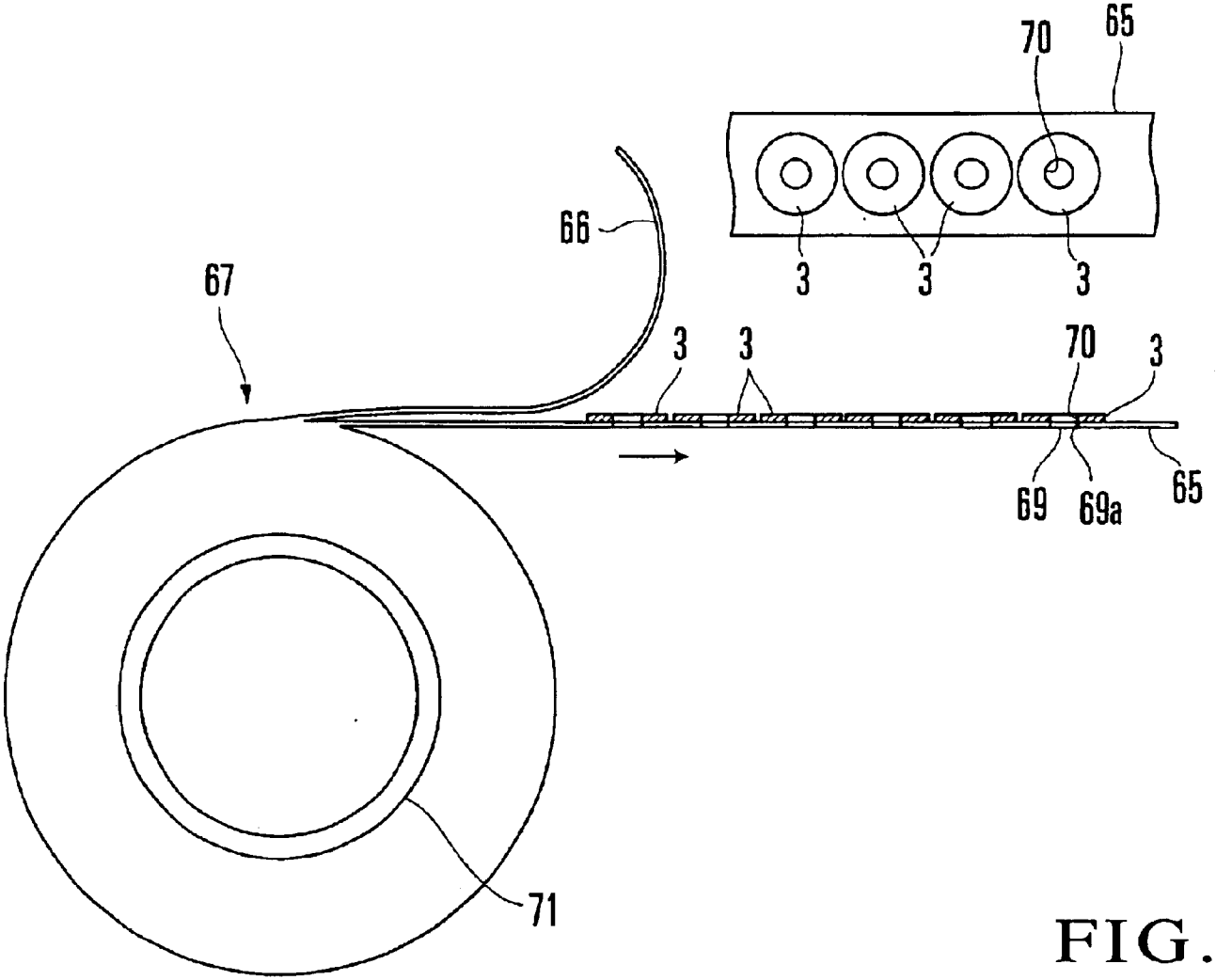
FIG. 22 is a view showing a seal tape.

The elastic seal 3 supplied to the seal adhering position A5 is loaded in a tape loader 68 (FIG. 16) in the form of a seal tape 67 which is formed by covering the elastic seal 3 with a mount 65 and protector paper 66 and wound in a roll shape, as shown in FIG. 22. The mount 65 has a width of 32 mm and positioning holes 69 on the center in the widthwise direction at the pitch of 24 mm. The elastic seal 3 is adhered to the mount 65 so as to match a central hole 70 of the elastic seal 3 with the positioning hole 69. The positioning hole 69 and the central hole 70 of the elastic seal 3 have the same diameter (8 mm). The protector paper 66 has the same width as that of the mount 65.

The seal tape 67 is wound around a spool 71, and both ends of a shaft 72 of the spool 71 are inserted, to be removable from upward, into bearing holes 74 formed on a pair of side plates 73 which form the tape loader 68 and oppose each other to support the seal tape 67. A protector paper separating mechanism 75 for separating the protector paper 66 from the mount 65, and a feed roller 76 for feeding the seal tape 67 from which the protector paper 66 is separated are disposed on the pair of left and right side plates 73. The protector paper separating mechanism 75 is constituted by a first roller 78 disposed above the bearing hole 74 by a support member (not shown), and a second roller 79 disposed to be rotatable between the upper rear end portions of the pair of side plates 73. The protector paper 66 separated from the seal tape 67 comes into contact with the rollers 78 and 79 to be dropped down by its own weight when the seal tape 67 is fed. The feed roller 76 is rotatably axially supported by a bearing hole 80 formed on the upper surface of the pair of side plates 73 on the front end side, and brought into contact with the lower surface of the seal tape 67 from which the protector paper 66 is separated (the lower surface of the mount).

Figure 16:
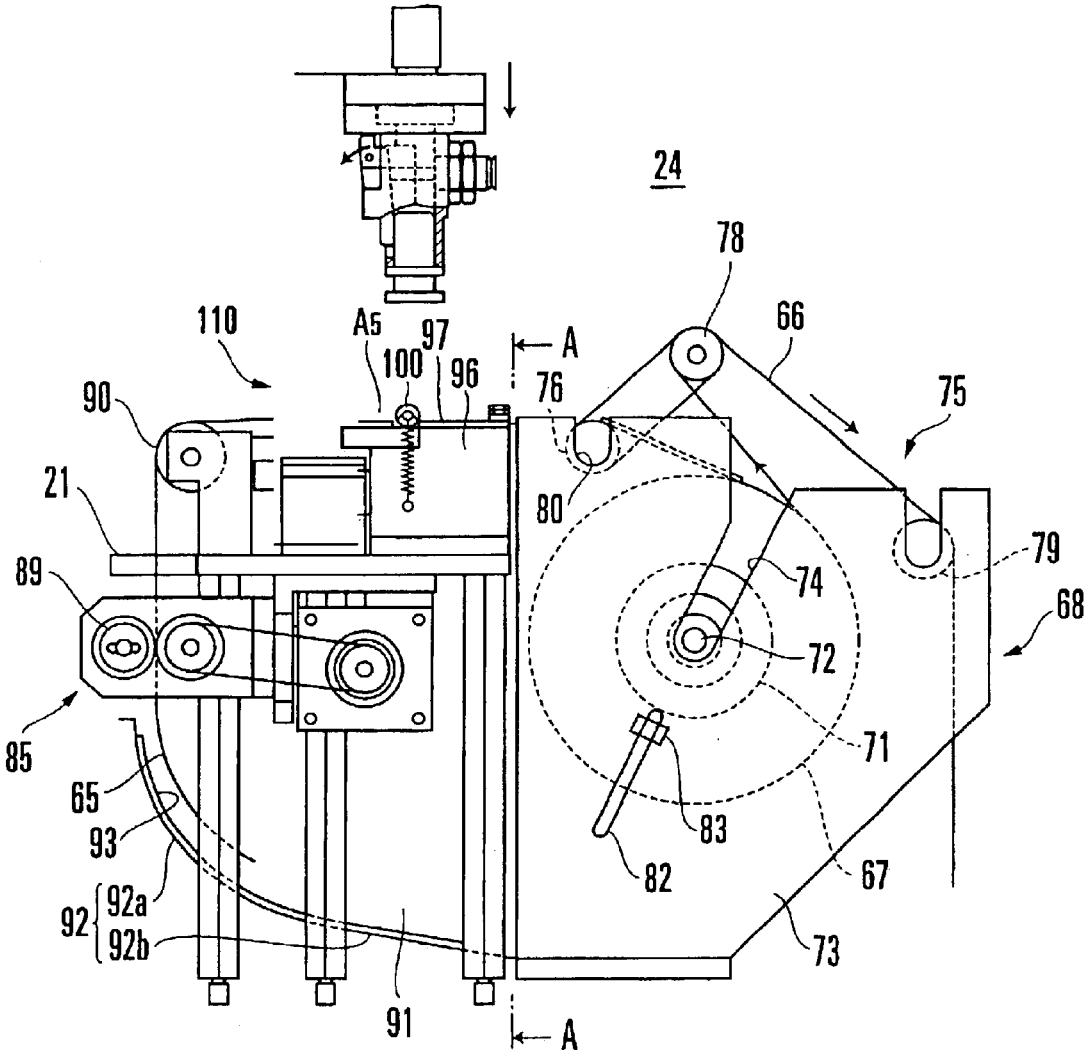
FIG. 16 is a front view of a seal supply unit.
Figure 17:
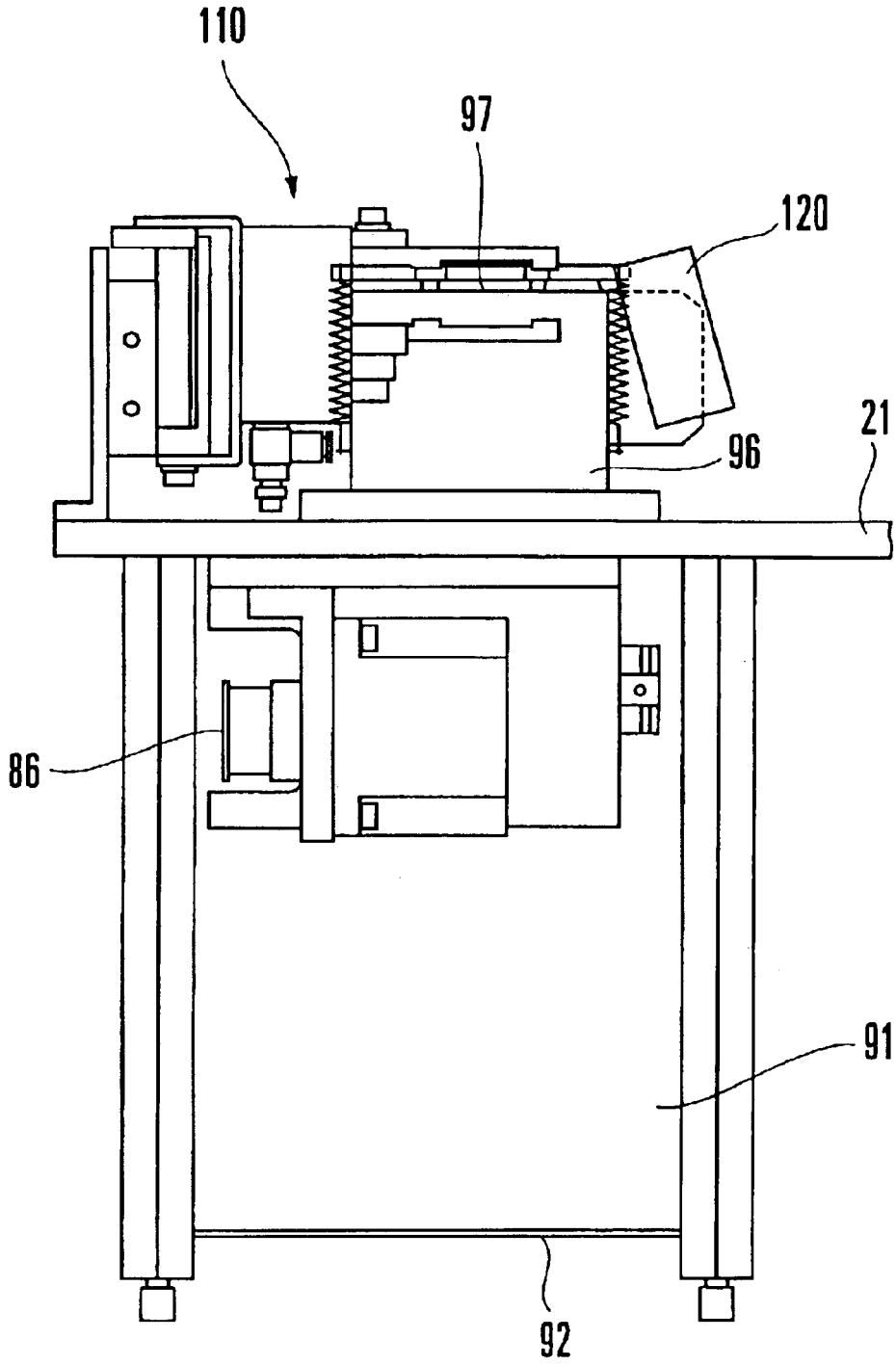
FIG. 17 is a sectional view taken along the line A—A shown by the arrows in FIG. 16.
Figure 18:
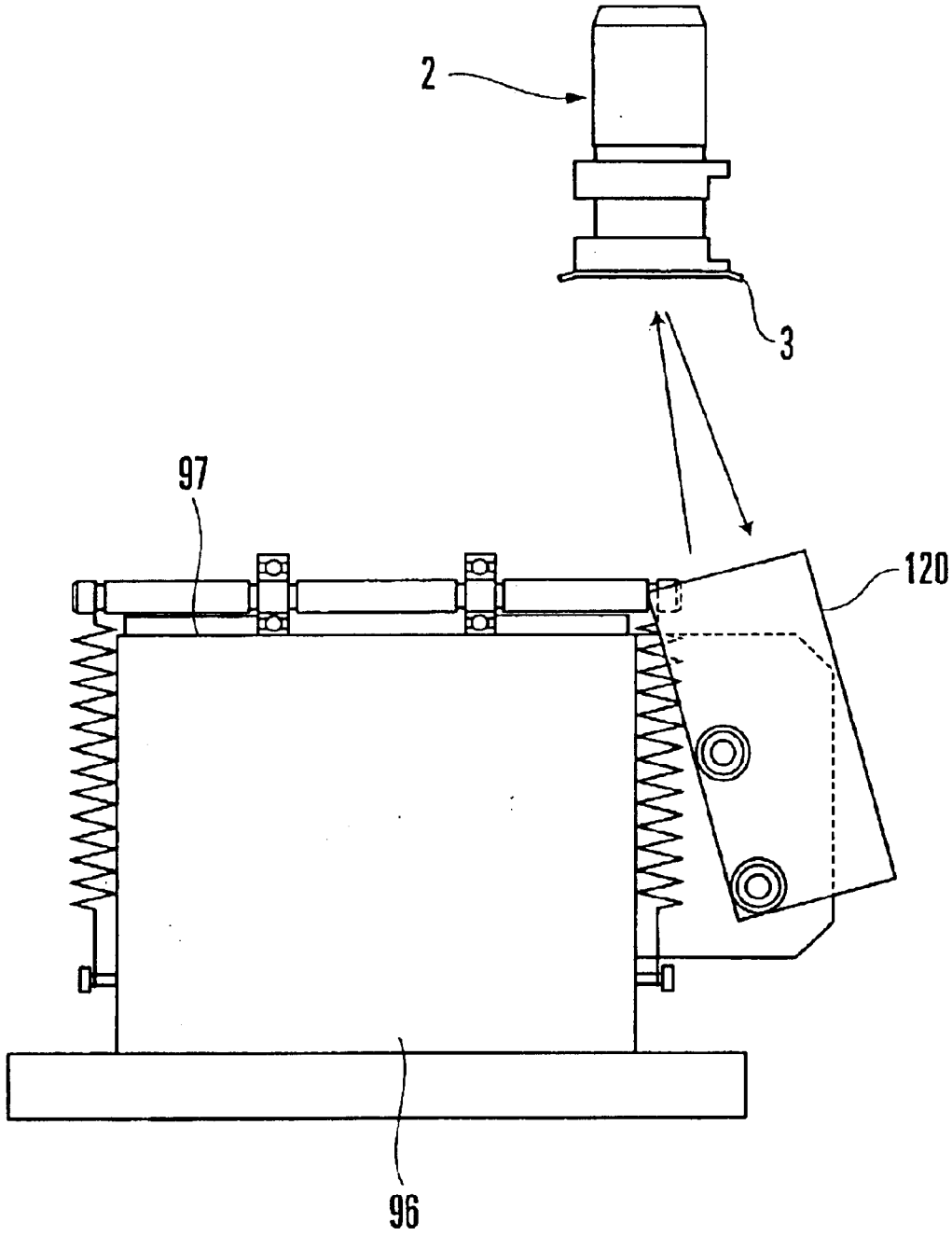
FIG. 18 is a view showing a feeding roller.

An elongated hole 82 is formed in one of the pair of side plates 73 in front of the unit FIG. 16, and a remaining tape amount detection sensor 83 for detecting the remaining amount of the seal tape 67 is disposed in the elongated hole 82. The elongated hole 82 is formed in the radial direction of the seal tape 67 and has a length larger than the difference between the maximum diameter and minimum diameter of the seal tape 67. One end of the elongated hole 82 positions near the outer surface of the spool 71, and the other end positions outside the maximum diameter of the seal tape 67. The remaining tape amount detection sensor 83 is attached on the terminal end portion of the elongated hole 82 on the spool 71 side. When the remaining amount of the seal tape 67 reaches the predetermined amount, the remaining tape amount detection sensor 83 turns on to detect the remaining amount and sends a detection signal to the controller. Since the seal tape 67 can visually be confirmed through the elongated hole 82, visual confirmation of a remaining tape amount can be performed.

A tape feed mechanism 85 for intermittently feeding and supplying the seal tape 67 loaded on the tape loader 68 to the seal adhering position A5 is disposed on the left side of the tape loader 68. The tape feed mechanism 85 is constituted by a stepping motor 86 attached on the lower surface side of the base 21, a gear 88 to which rotation of the motor 86 is to be transmitted through a timing belt 87, an urging roller 89, and the like, and the urging roller 89 urges the used-up mount 65 against the gear 88 at a predetermined pressure. When, accordingly, the stepping motor 86 is driven to rotate the gear 88 and urging roller 89 in the tape feed direction, the seal tape 67 is fed from the tape loader 68. The tape feed mechanism 85 also has a mount feeding roller 90 disposed above the base 21 to be rotatable. A mount storage portion 91 for collecting the used-up mount 65 guided downward by the gear 88 and urging roller 89 is formed below the base 21.

The mount storage portion 91 is formed by a metal plate 92 of stainless steel or the like and the lower surface of the base 21. The metal plate 92 has a curved portion 92*a* which is formed by folding and curved in an arc shape and an inclined portion 92*b* which is formed to extend from the lower end of the curved portion 92*a* and inclined toward the extending direction. The upper end of the curved portion 92*a* positions below the urging roller 89, and a tape is adhered to the entire surface of the metal plate 92 to make the mount 65 easily slide thereon.

A box convey path forming member 96 is disposed on the upper surface of the base 21, and has the central portion of an upper surface forming a seal convey path 97 of the seal tape 67. Inverted L-shaped tape guides 98 (FIGS. 19 and 20) for guiding both end portions, in the widthwise direction, of the seal tape 67 are formed on the both sides of the seal convey path 97. The front portion of the seal convey path 97 is set at the seal adhering position A5, where a press roller 100 for urging the both end portions, in the widthwise direction, of the mount 65 of the seal tape 67 against the seal convey path 97 to prevent the mount 65 from floating is disposed. The press roller 100 has a pair of bearings 101 and crosses the seal convey path 97, and both end portions of the press roller 100 are biased downward by coil springs 102, thereby urging the mount 65 against the upper surface of the convey path forming member 96 by using outer ball races of the bearings 101. The pair of bearings 101 are used to reduce a frictional force between the mount 65 and press roller 100 to smoothly convey the seal tape 67, and attached to the press roller 100 at a gap larger than the outer diameter of the elastic seal 3 so as to contact only the end portions of the mount 65.

An elastic member 104 of rubber or the like is disposed at the seal adhering position A5 (FIG. 20) through a metal plate 105. The upper surface of the elastic member 104 forms a single surface together with the upper surface of the convey path forming member 96 to form a portion of the seal convey path 97. The outer ball races of the bearings 101 contact the portion of the upper surface of the elastic member 104 on the tape loader 68 side. A circular hole 106 is formed to extend through almost the central portion of the elastic member 104. The hole 106 has a diameter equal to that of the center hole 70 of the elastic seal 3, and its center coincides with that of the seal adhering position A5. A hole 107 having a diameter which is equal to and coincides with that of the hole 106 is also formed on the metal plate 105. A photosensor 108 in a reflecting form for detecting the positioning hole 69 of the mount 65 is disposed in the hole 107. The photosensor 108 is used to stop the elastic seal 3 at the seal adhering position A5, and turns on when a front edge 69*a* (a hole edge on the tape conveying side) of the positioning hole 69 is detected. When the detection signal is sent to the controller, the controller stops the stepping motor 86 after an elapse of a predetermined time period. The time period since the photosensor 108 detects the front edge 69*a* of the positioning hole 69 until the controller sends the signal to the stepping motor 86 to stop it is equal to a time period required for moving the seal tape 67 by a radius of the positioning hole 69, so that the elastic seal 3 is accurately positioned and stopped at the center of the seal adhering position A5. This stop position sets as a reference adhering position of the elastic seal 3.

Figure 19:
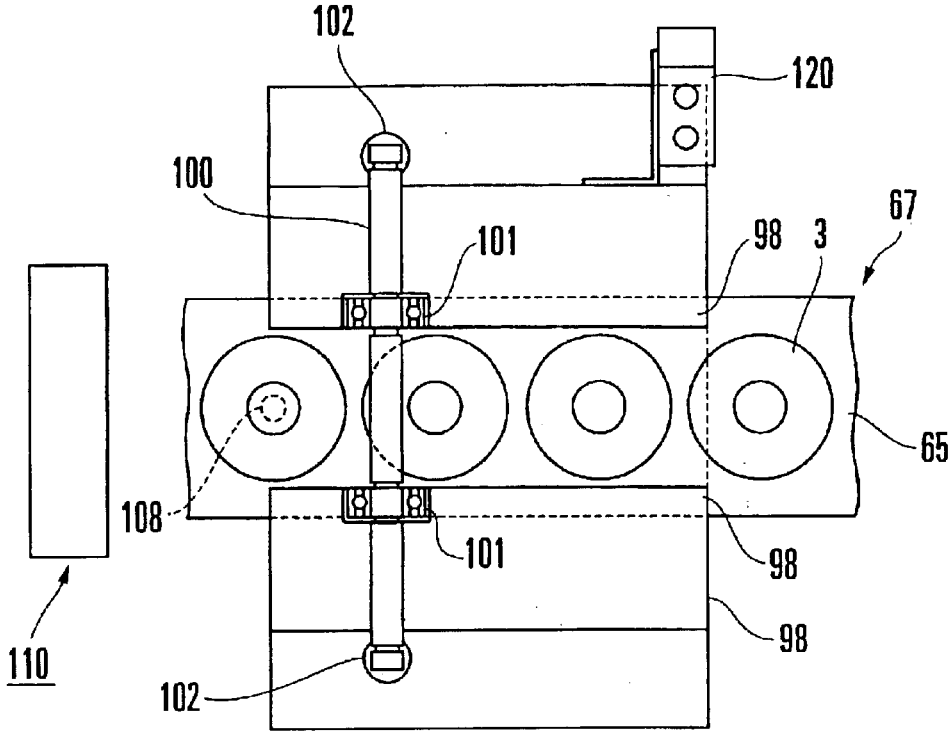
FIG. 19 is a plan view showing a seal adhering position and the vicinity thereof.
Figure 20:
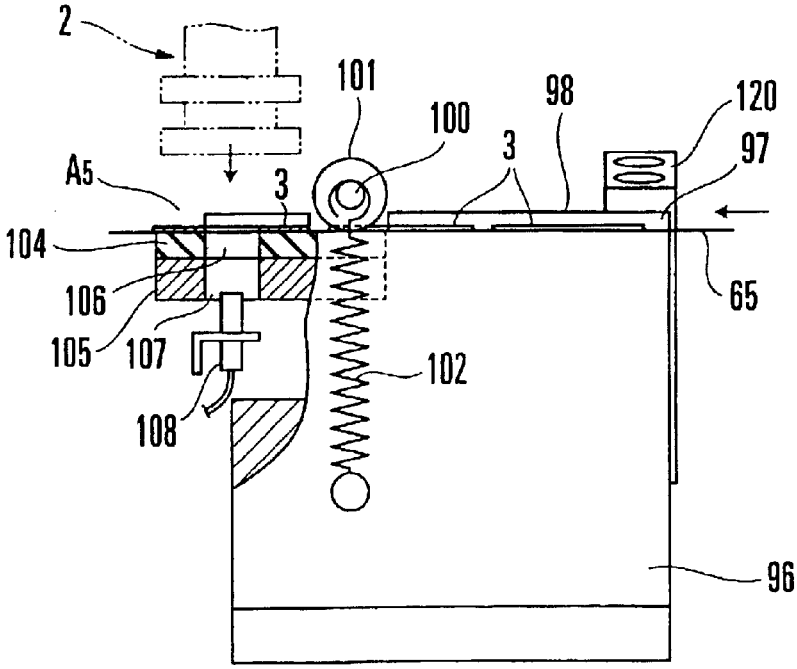
FIG. 20 is a sectional view of the seal adhering position.
Figure 21A:
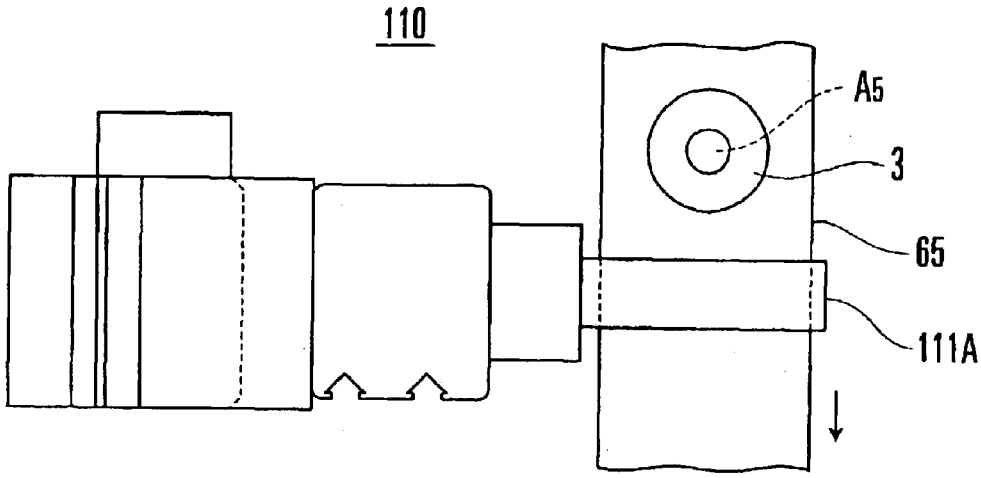
FIGS. 21A and 21B are plan and side views, respectively, of a seal separating mechanism.
Figure 21B:
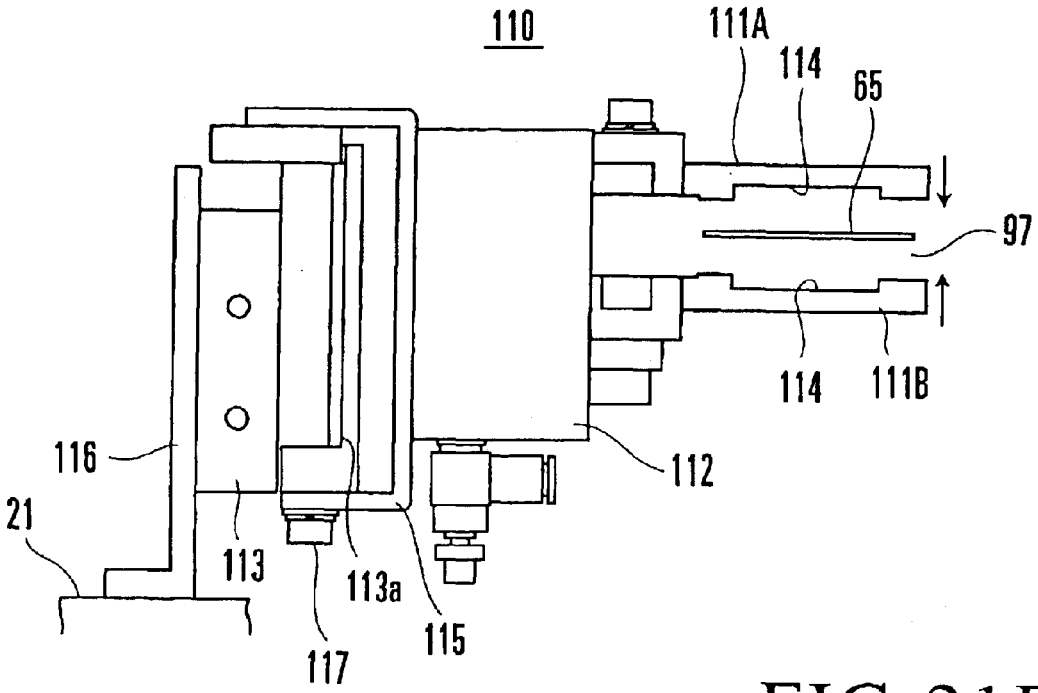

A seal separating mechanism 110 for separating the elastic seal 3 from the mount 65 when the lens holder 2 is urged against the elastic seal 3 is disposed immediately behind the seal adhering position A5. As shown in FIGS. 21A and 21B, this seal separating mechanism 110 is constituted by a pair of clamping members 111A and 111B which are disposed to sandwich the seal convey path 98 (FIGS. 19 and 20)

immediately behind the seal adhering position A5 therebetween and to oppose each other via the seal convey path, a first air cylinder 112 for making the clamping members 111A and 111B move synchronically in a direction to be close to and apart from each other, and a second air cylinder 113 for making the clamping members 111A and 111B move downward together with the first air cylinder 112 by a predetermined distance after the clamping members clamp the mount 65. The clamping members 111A and 111B are made of symmetrical plate members, and grooves 114 are formed at the centers of the clamping surfaces of the clamping members. The first air cylinder 112 is fixed to a bracket 115. The second air cylinder 113 is fixed to a bracket 116 formed on the base 21, and the bracket 115 is fixed on a movable member 113*a* by a set screw 117.

Figure 2:
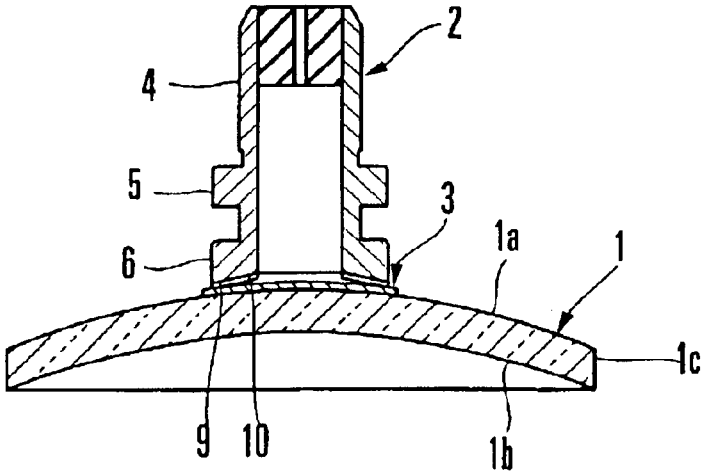
FIG. 2 is a view showing a state in which a lens is held by the lens holder through an elastic seal.
Figure 3A:
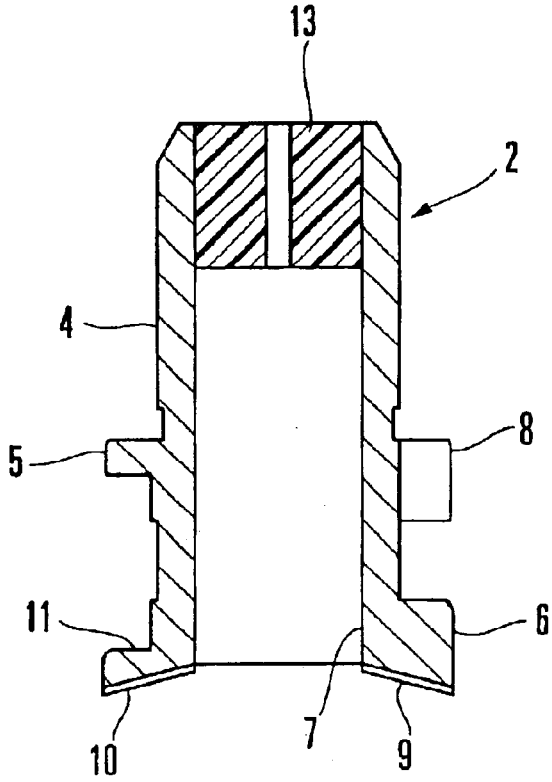
FIGS. 3A, 3B, and 3C are an enlarged sectional view taken along the line III—III of FIG. 1A, a view showing a lens holding surface, and an enlarged sectional view of this lens holding surface, respectively.
Figure 3B:
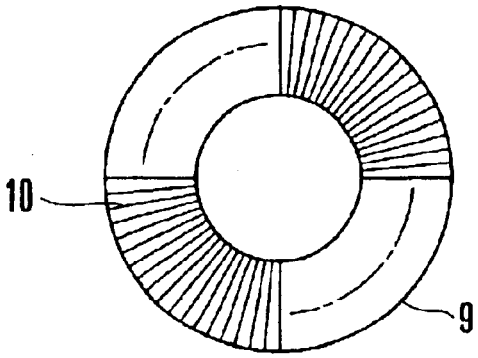
Figure 3C:
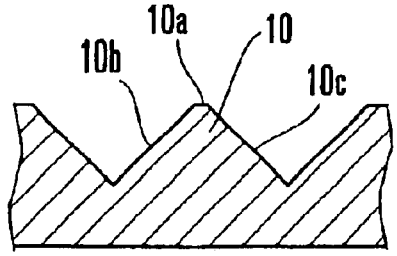

In this the seal supply unit 24, when the seal tape 67 is supplied from the tape loader 68, and the elastic seal 3 is positioned and stopped at the seal adhering position A5, the clamp unit 61 of the holder holding unit 23 is moved, upon pivot motion of the pivotal arm 60, above the seal adhering position A5, and is stopped there. Subsequently, the clamp unit 61 moves downward to urge the lens holding surface 9 of the lens holder 2 against the upper surface of the elastic seal 3, so the projections 10 bite the elastic seal 3. At this time, the first air cylinder 112 is driven to move the clamping members 11A and 111B to be close to each other, so the clamping members 11A and 111B clamp the end portion of mount 65. Subsequently, the second air cylinder 113 is driven to move the bracket 115 downward by a predetermined distance. Thus, the clamping members 111A and 111B are also moved downward by the predetermined distance, so the mount 65 clamped by these clamping members is drawn. On the other hand, since the elastic seal 3 is adhered to the lens holding surface 9 of the lens holder 2, it is separated from the mount 65. By moving the clamp unit 61 upward to be restored, the elastic seal 3 is completely separated from the mount 65, so that supplying the elastic seal 3 to the lens holder 2 is ended. After that, the clamp unit 61 is moved to the lens holding position A6 with the pivot motion of the pivotal arm 60. The clamp unit 61 is moved downward to urge the elastic seal 3 adhered to the lens holder 2 against the lens 1 supplied to the lens holding position A6, so that the elastic seal 3 comes into tight contact with the lens 1. The lens 1 is thus held by the lens holder 2 through the elastic seal 3. FIG. 2 shows this state.

Note that, other than the photosensor 108 described above, the seal supply unit 24 is comprised of the lens holder 2 itself and a photosensor 120 in a reflecting form (FIGS. 17 and 18) for detecting whether the elastic seal 3 has been adhered to the lens holding surface 9 of the lens holder 2.

Referring to FIG. 5, the lens supply unit 25 has two guide rails 130, a Y-table 132 which is moved in the Y-axis direction by a ball screw 131, an X-table 136 set on the Y-table 132 through two guide rails 134 and a ball screw 135 so as to be movable in the X-axis direction, and a Z-table 137 set on the X-table 136 and movable in the Z-axis direction, driving motors (not shown) for driving these tables, and the like. The Z-table 137 has a pair of left and right hands 138A and 138B, and holds the edge of the lens 1 supplied to the lens supply unit 25 at four points with these hands. Upon receiving the lens 1 supplied to the lens supply unit 25 and holding it, the pair of hands 138A and 138B convey it to the lens meter 26. Measurement of the lens is performed. When measurement is ended, the hands 138A and 138B convey the lens 1 to the lens holding position A6 and place it on a lens support table, and the lens holder 2 held by the clamp unit 61 then holds the lens 1. During this period of time, the height of the concave lens surface of the lens is measured.

The lens meter 26 measures the lens power, optical center, cylinder axis, and the like of the lens 1 supplied to the lens supply unit 25, performs optical layout of the lens 1, and calculates and determines the attaching position, angle, and the like of the lens holder 2 with respect to the lens 1 on the basis of lens frame shape data. The lens meter 26 outputs the determined result to the controller.

When the lens holder 2 holds the lens 1 at the lens holding position A6, this lens holder 2 is conveyed to the holder transfer position A7 and stopped there. Upon removing from the clamp unit 61, the lens holder 2 is conveyed to the edger by an appropriate convey robot. Thereafter, the lens 1 is edged by an arris process and the like in accordance with a processing program based on the lens frame shape data, and finally, a lens with an outline almost coinciding with the shape of the frame is fabricated.

Figure 23:
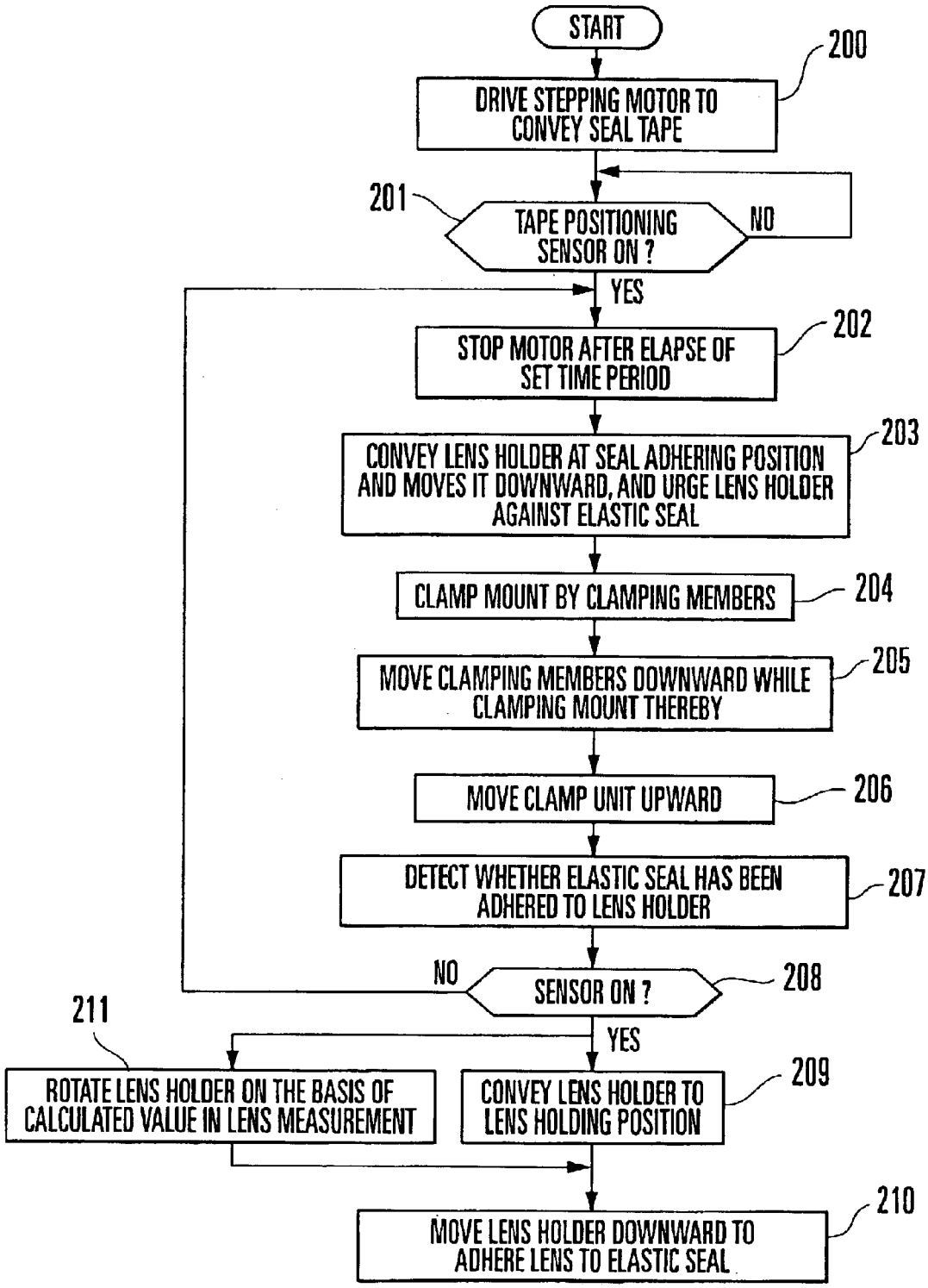
FIG. 23 is a flow chart showing the adhering operation of an elastic seal.

A method of adhering a seal to the lens holder 2 will be described next on the basis of FIG. 23. The stepping motor 86 is driven to convey the seal tape 67, from which the protector paper 66 is separated, to the seal adhering position A5 at a predetermined speed (step 200). When the seal tape 67 has been conveyed to the seal adhering position A5 and the front edge 69*a* of the positioning hole 69 of the mount 65 coincides with the sensor 108, the sensor 108 turns on to detect the positioning hole 69 (step 201), and sends a detection signal to the controller. Upon receiving the detection signal from the sensor 108, the controller stops conveyance of the seal tape 67 by the stepping motor 86 after the time period set by the diameter of the hole, the rotation speed of the motor, and the like is elapsed (step 202). By stopping this conveyance, the position of the positioning hole 69 which has coincided with the sensor 108 is positioned as the reference adhering position of the elastic seal 3. The set time period is a time period required for moving the center of the positioning hole 69 to the center of the sensor 108 after the sensor 108 detects the front edge 69*a* of the hole 69.

When the elastic seal 3 is positioned and stopped at the reference adhering position, the holder holding unit 23 makes the pivotal arm 60 pivot on the basis of reference adhering position information from the controller, and makes the clamp unit 61 holding the lens holder 2 move above the seal adhering position A5 and stop there. The holder holding unit 23 then makes the clamp unit 61 move downward to urge the lens holding surface 9 of the lens holder 2 against the elastic seal 3, so the projections 10 bite the elastic seal 3 (step 203). When the lens holder 2 is urged against the elastic seal 3, the first air cylinder 112 is driven to move the pair of clamping members 111A and 111B in the direction to be close to each other (FIG. 21B), to clamp the end portion of the mount 65 (step 204). Subsequently, the second air cylinder 113 is driven to move the bracket 115 downward by a predetermined distance. Thus, the pair of clamping members 111A and 111B are also moved downward by the predetermined distance, so the clamped mount 65 is drawn (step 205). When the clamp unit 61 is moved upward to be restored in synchronization to this, the elastic seal 3 adhered to the lens holding surface 9 of the lens holder 2 is separated from the mount 65, and adhesion of the elastic seal 3 to the lens holder 2 is ended (step 206).

After that, the clamp unit 61 moves above the lens holding position A6 with the pivot motion of the pivotal arm 60. During this movement, the sensor 120 detects whether the elastic seal 3 has been adhered to the lens holder 2 (steps 207 and 208). If no elastic seal 3 is adhered to the lens holder 2, the controller receives a signal from the sensor 120 and then sends an adhesion signal to the holder holding unit 23 to make it perform adhesion operation of the elastic seal again.

When the lens holder 2 adhered with the elastic seal 3 moves to the lens holding position A6 and stops there (step 209), the clamp unit 61 moves downward and the elastic seal 3 adhered to the lens holder 2 is then urged against the lens supplied to the lens holding position, so that the elastic seal 3 comes into tight contact with the lens 1 (step 210). The lens 1 is thus held by the lens holder 2 through the elastic seal 3. At this time, the lens holder 2 is rotated by a predetermined angle in advance on the basis of the calculated value in the lens measurement, and the elastic seal 3 is then urged against the lens 1 (step 211).

According to the APS 20 described above, when the lens holder 2 is supplied to the chutes 30, the lens 1 is supplied to the lens supply unit 25, and the lens frame shape data is input to the controller by using a terminal equipment such as a keyboard or touch panel, a series of the steps of supplying the lens holder 2, centering of the lens holder 2, supplying the elastic seal 3, adhering the elastic seal 3 to the lens holder 2, holding the lens 1 by the lens holder 2, and measuring the lens 1 are entirely automatically performed. Therefore, the burden to the operator is reduced considerably, the operating efficiency and productivity are improved, and labor saving can be achieved. Also, since the seal supply unit 24 has the seal separating mechanism 110 to forcibly separate the elastic seal 3 from the mount 65, the elastic seal 3 is reliably adhered to the lens holder 2.

In addition, after the seal supply unit 24 positions the elastic seal 3 at the reference adhering position, the clamp unit 61 conveys the lens holder 2 above the reference adhering position and moves it downward, thereby urging the lens holder 2 against the elastic seal 3 to be adhered to it. Therefore, the elastic seal 3 is accurately adhered to the lens holding surface 9 of the lens holder 2. Accordingly, the operator need not adhere the elastic seal to the lens holder one by one, and the operating efficiency can be improved.

In the above embodiment, the present invention is applied to an APS for a single-vision lens. However, the present invention is not limited to this, and can also be applied to an APM for a multifocal lens.

As has been described above, according to the present invention, there is provided the seal supply unit for supplying the elastic seal, so an operator need not adhere the elastic seal to the lens holder one by one. Therefore, the burden to the operator is reduced considerably, the operating efficiency and productivity are improved, and labor saving can be achieved. In addition, the lens is not soiled or damaged. Further, since the seal separating mechanism is provided, the elastic seal is reliably separated from the mount.

Furthermore, the seal tape is conveyed to the seal adhering position, the front edge of the positioning hole of the mount is detected by the sensor, and conveyance of the seal tape is stopped after the seal tape is fed from the detection position for a predetermined time period. That position is then determined as the reference adhering position of the elastic seal, and the holder holding unit is driven and controlled on the basis of information of the reference adhering position to urge the lens holder against the elastic seal to be adhered to it. With this operation, an operator need not adhere the elastic seal to the lens holder one by one. Therefore, the burden to the operator is reduced considerably, the operating efficiency and productivity are improved, and labor saving can be achieved. The lens is not soiled or damaged.

What is claimed is:

1. A lens layout block device comprising:

a seal supply unit for supplying an elastic seal which is to be adhered to a lens holder, a unit for adhering a supplied elastic seal to the lens holder, and a lens holder holding unit for causing the lens holder adhered with an elastic seal to hold a lens, wherein said seal supply unit has:

a tape loader on which a seal tape formed by covering the elastic seal with a mount and a protector paper and wound in a roll shape is to be loaded, a tape feed unit for intermittently feeding the seal tape from said tape loader, a protector paper separating unit for separating the protector paper of the seal tape fed from said tape loader, and means on which the lens holder is urged against an elastic seal at a seal adhering position.

2. A lens layout block device according to claim 1, further comprising a seal separating unit for separating an elastic seal from the mount.

3. A lens layout block device according to claim 2, wherein said seal separating unit comprises:

a pair of clamping members which are disposed to sandwich a seal convey path immediately behind the seal adhering position therebetween and to vertically oppose each other via the seal convey path, to clamp the mount, a first driving unit for making said clamping members move in a direction to be close to and apart from each other, and a second driving unit for making said pair of clamping members move downward after said clamping members clamp the mount.

4. A lens layout block device according to claim 1, characterized in that the mount has a positioning hole, and said seal supply unit has a sensor for detecting the positioning hole of the mount arranged below the seal adhering position.

5. A lens layout block device according to claim 1, characterized in that said lens holder holding unit comprises a pivotal arm, an arm driving unit for pivoting said pivotal arm within a horizontal plane, a clamp unit attached to be vertically movable to hold said lens holder, a clamp driving unit for making said clamp unit move in the vertical direction, and a lens holding position which holds a lens and the seal adhering position of said seal supply unit on a pivot track of said clamp unit of said pivotal arm.

6. A lens layout block device according to claim 4, characterized in that said clamp unit has a cylindrical main body to fit on said lens holder, and a holder fixing unit for fixing said lens holder to said main body.

7. A lens layout block device according to claim 5, characterized in that said holder fixing unit has a pivotal holder fixing member, a spring for biasing said holder fixing member in a direction to separate from said lens holder, and a driving unit for urging said lens holder against said lens holder.

8. A lens layout block device according to claim 1, further comprising an arm fixing unit for fixing said pivotal arm to a pivot position thereof when said clamp unit moves to a lens holding unit.

* * * * *